US007979940B1

(12) United States Patent
Wilkins

(10) Patent No.: US 7,979,940 B1
(45) Date of Patent: Jul. 19, 2011

(54) FLUID-POWERED LIQUID-DISPENSER APPARATUS

(76) Inventor: Larry C. Wilkins, Ft. Lauderdale, FL (US)

( * ) Notice: Subject to any disclaimer, the term of this patent is extended or adjusted under 35 U.S.C. 154(b) by 373 days.

(21) Appl. No.: 11/866,172

(22) Filed: Oct. 2, 2007

Related U.S. Application Data

(63) Continuation-in-part of application No. PCT/US2006/040551, filed on Oct. 16, 2006.

(60) Provisional application No. 60/799,692, filed on May 11, 2006.

(51) Int. Cl.
*A47L 23/02* (2006.01)
*A47L 23/06* (2006.01)

(52) U.S. Cl. ..... 15/24; 134/34

(58) Field of Classification Search ..... None
See application file for complete search history.

(56) References Cited

U.S. PATENT DOCUMENTS

| | | | | |
|---|---|---|---|---|
| 518,352 | A | 4/1894 | Nightingale | |
| 843,377 | A | 2/1907 | Ullrich et al. | |
| 1,414,605 | A | 5/1922 | Tolookjian | |
| 1,423,844 | A | 7/1922 | Fenelon | |
| 1,679,561 | A | 8/1928 | Cantrell | |
| 1,817,644 | A | 8/1931 | Pope | |
| 1,841,414 | A | 1/1932 | McBride | |
| 1,910,235 | A | 5/1933 | Burkett | |
| 2,142,947 | A | 1/1939 | Kretzschmar et al. | |
| 2,723,407 | A | 11/1955 | Bardon | |
| 3,199,957 | A | 8/1965 | Vivion | |
| 3,599,267 | A | 8/1971 | Faires | |
| 3,748,678 | A | 7/1973 | Ballou | |
| 4,154,258 | A | 5/1979 | Duda et al. | |
| 4,461,052 | A | 7/1984 | Mostul | |
| 4,532,666 | A * | 8/1985 | Smyth | 15/22.1 |
| 4,581,785 | A | 4/1986 | Suzuki | |
| 4,780,922 | A | 11/1988 | Sanchez | |
| 4,780,992 | A | 11/1988 | McKervey | |
| 5,146,642 | A | 9/1992 | Mank et al. | |
| 5,235,717 | A | 8/1993 | Lanzo, Jr. et al. | |
| 5,301,472 | A | 4/1994 | Lyng | |
| 5,987,682 | A | 11/1999 | Rossi | |
| 6,068,204 | A | 5/2000 | Alexander | |
| 6,582,668 | B2 | 6/2003 | Green | |
| 6,594,843 | B1 | 7/2003 | Wilkins | |
| 6,792,639 | B2 | 9/2004 | Wilkins | |
| 6,814,306 | B1 | 11/2004 | Okubo | |
| 7,011,254 | B2 | 3/2006 | Thornton | |
| 2003/0200615 | A1 * | 10/2003 | Wilkins | 15/24 |

* cited by examiner

*Primary Examiner* — Michael Barr
*Assistant Examiner* — Jason Y Ko
(74) *Attorney, Agent, or Firm* — Finnegan, Henderson, Farabow, Garrett & Dunner, L.L.P.

(57) ABSTRACT

A tool powered by pressurized liquid, typically water, for treatment of a variety of surfaces ranging from natural to manufactured, has a scrubber wheel powered by the pressurized liquid. A treatment liquid is contained in a single-use, throw-away cartridge mounted in the tool. The cartridge is mounted in the tool for rotation therein when desired. A nozzle in the tool for discharging the pressurized liquid onto the scrubber wheel to rotate the scrubber wheel, is movable by the tool operator during a treatment operation to change the direction of discharge to the extent desired to drive the scrubber forward or backward and to rotate the cartridge to dispense the treatment liquid if, and when, dispensing of the treatment liquid is desired.

16 Claims, 33 Drawing Sheets

FLUID-POWERED LIQUID-DISPENSER APPARATUS

CROSS REFERENCE TO RELATED APPLICATIONS

This application is a continuation-in-part of International Application No. PCT/US2006/040551 filed Oct. 16, 2006, contents of which are incorporated herein and on which priority is claimed herein. This application is also related to U.S. application Ser. No. 11/254,647 filed Oct. 20, 2005, now U.S. Pat. No. 7,703,165, which issued Apr. 27, 2010, and to Provisional Application No. 60/799,692 filed May 11, 2006.

BACKGROUND

This invention relates generally to dispensers, and more particularly to a dispenser able to dispense a liquid into a stream of another liquid which also causes the dispensing action to occur.

Varieties of dispensers for liquid materials are known. Some of them use a liquid to cause the dispensing of a different liquid. Examples are shown in some prior art patents listed on an accompanying Information Disclosure Statement. These examples seem to be limited to specific applications. There is a need for a dispenser of relatively simple and inexpensive construction and operation and adaptable to a variety of applications.

SUMMARY

Figure 1:
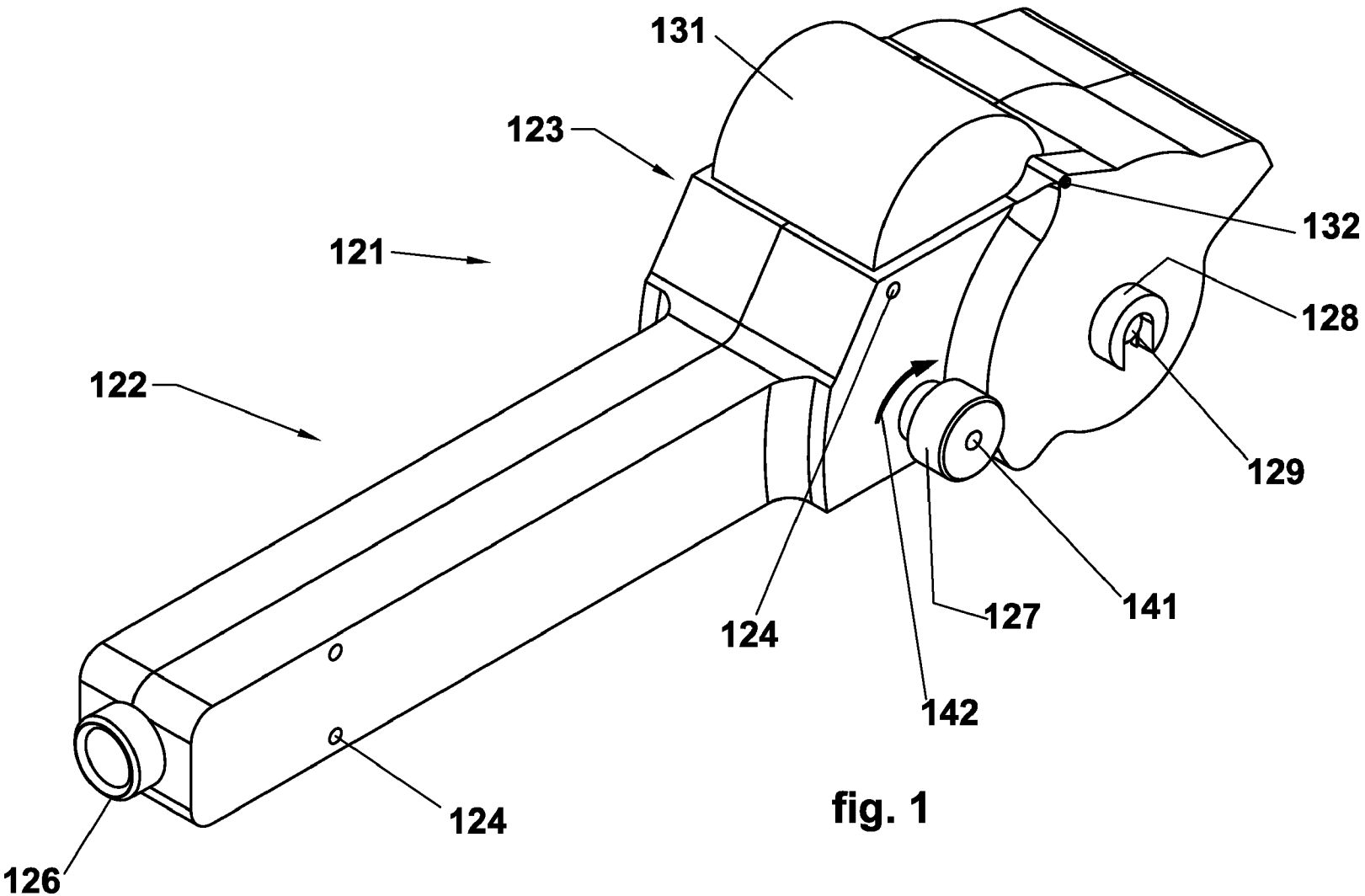
FIG. 1 is a perspective view of a portable scrubbing apparatus looking toward its proximal end, and incorporating a dispensing system according to one embodiment of the present invention.
Figure 2:
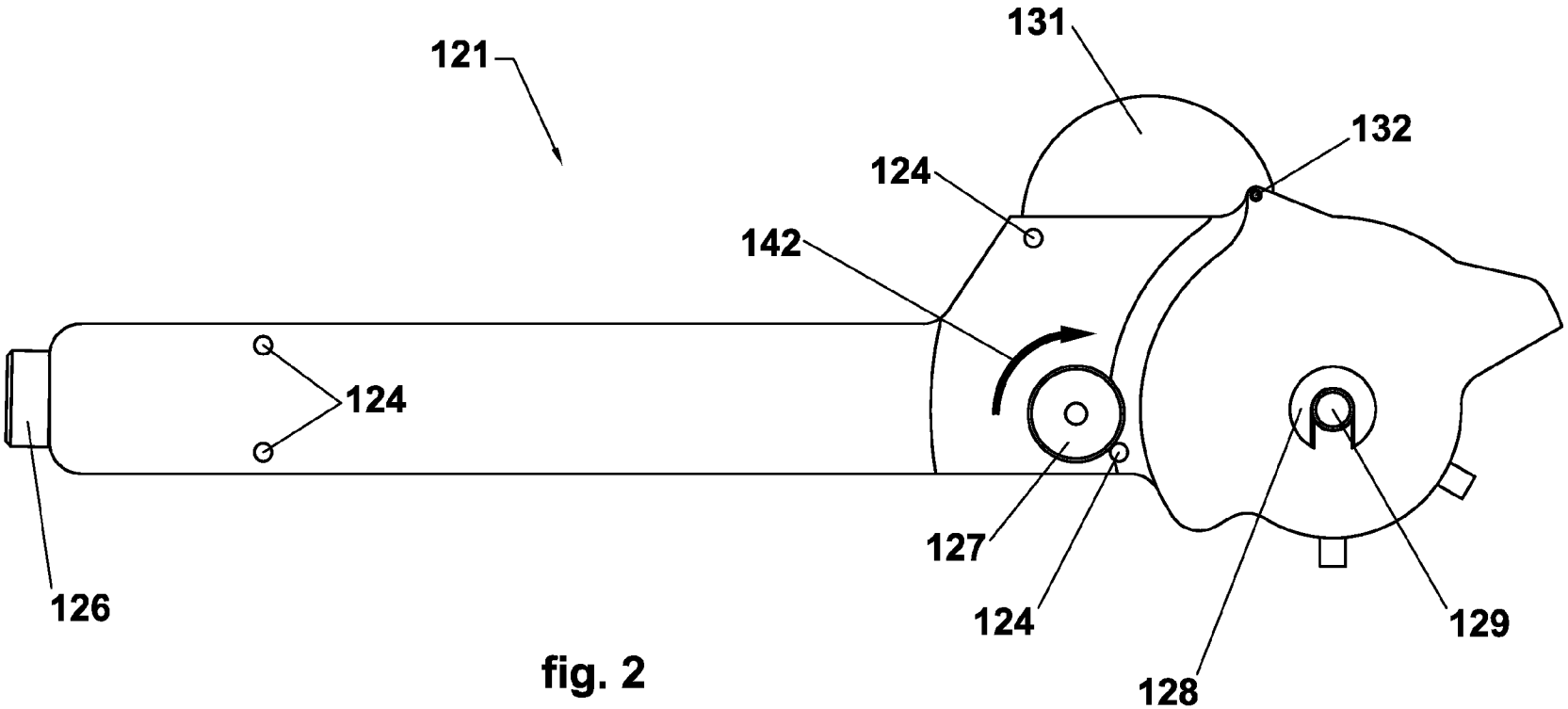
FIG. 2 is a side elevational view thereof.
Figure 3:
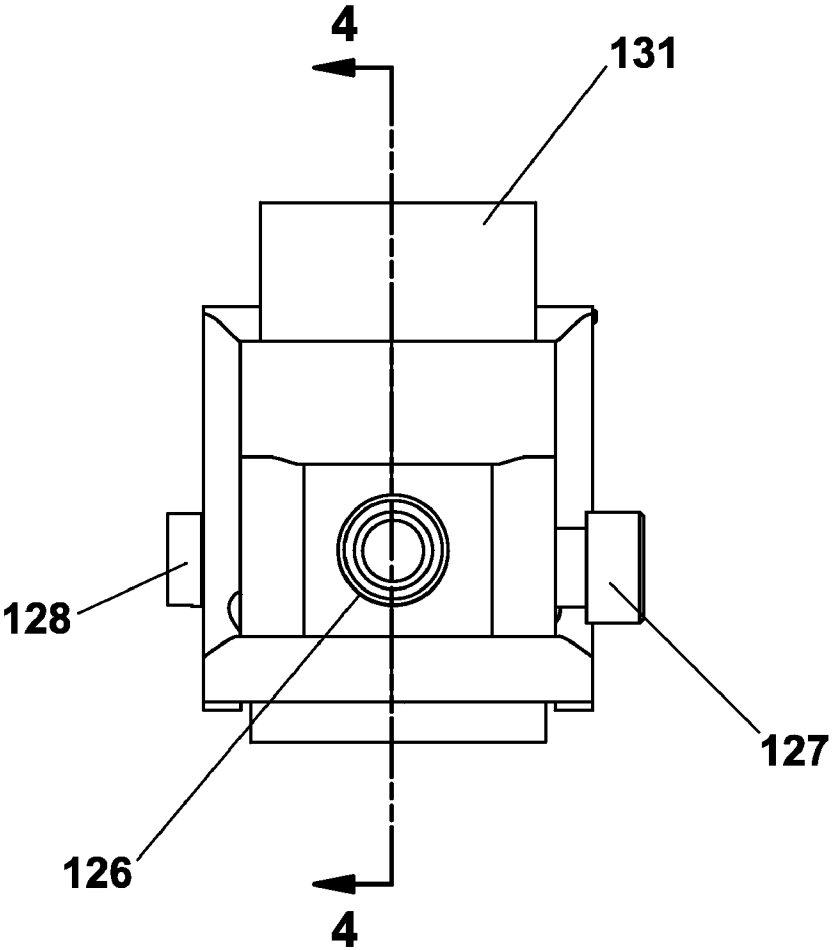
FIG. 3 is an end view thereof looking at the proximal end.

For a surface treatment apparatus, a cartridge for containing and dispensing a treatment liquid for application to some kind of surface, is provided to contain the liquid when the cartridge is at rest. But the cartridge is arranged for discharge of the liquid in response to rotation centered on an axis. Rate of discharge is responsive to speed of rotation, such as increasing rate of discharge of treatment liquid in response to increasing speed of rotation. The cartridge is susceptible to rotation in response to contact of a smooth peripheral surface of the cartridge by a flowing fluid. The dispensed treatment liquid may be mixed into the fluid flow or directed otherwise.

The cartridge is provided containing treatment liquid suitable to the intended application and is constructed and situated for quick and easy change so is readily replaceable in the treatment apparatus, by another cartridge, for additional treatment material of the same kind or of another kind for other treatment, and is expendable.

The cartridge is responsive to various directions of application of fluid flow to the cartridge surface.

DETAILED DESCRIPTION OF THE ILLUSTRATED EMBODIMENT

Referring now to FIGS. 1 through 10, the scrubbing apparatus 121 has a handle portion 122 and a housing portion 123. This can be made of two molded plastic shells secured together by rivets 124. Other approaches may be used if desired. Being portable, it can be carried easily by hand. There is a fitting 126 at the proximal end and which may be conveniently connected to a garden hose for supply of water, or to a high pressure washer device or to some other source of pressurized mobilizing or carrier fluid supply. Other external features include a nozzle operating cam control knob 127, a scrubber wheel axle clip 128, the end of a scrubber wheel axle 129, a housing cover 131 and the end of a cover hinge pin 132.

Figure 4:
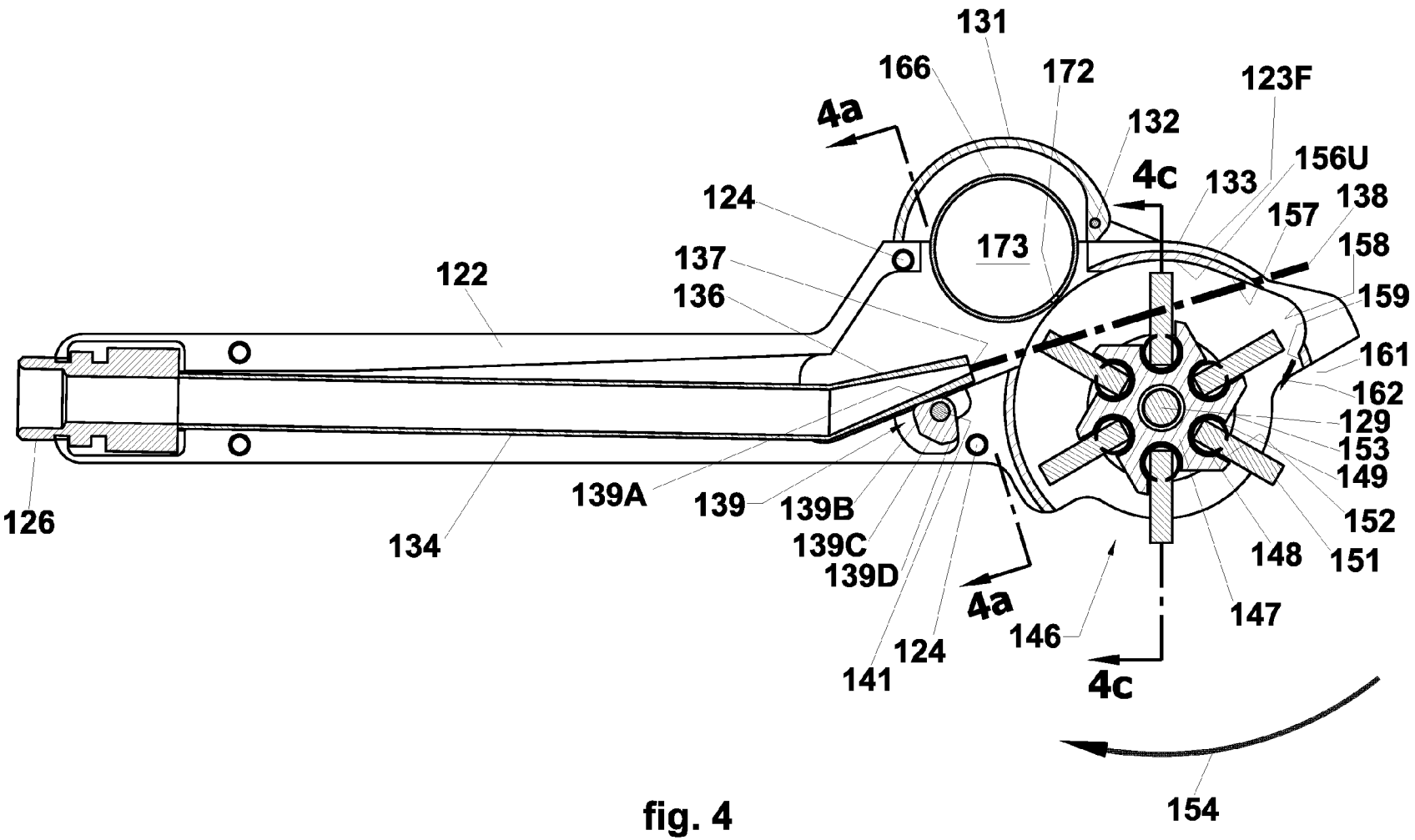
FIG. 4 is a cross-section through the FIG. 3 view at line 4-4 in FIG. 3 and viewed in the direction of the arrows.
Figure 5:
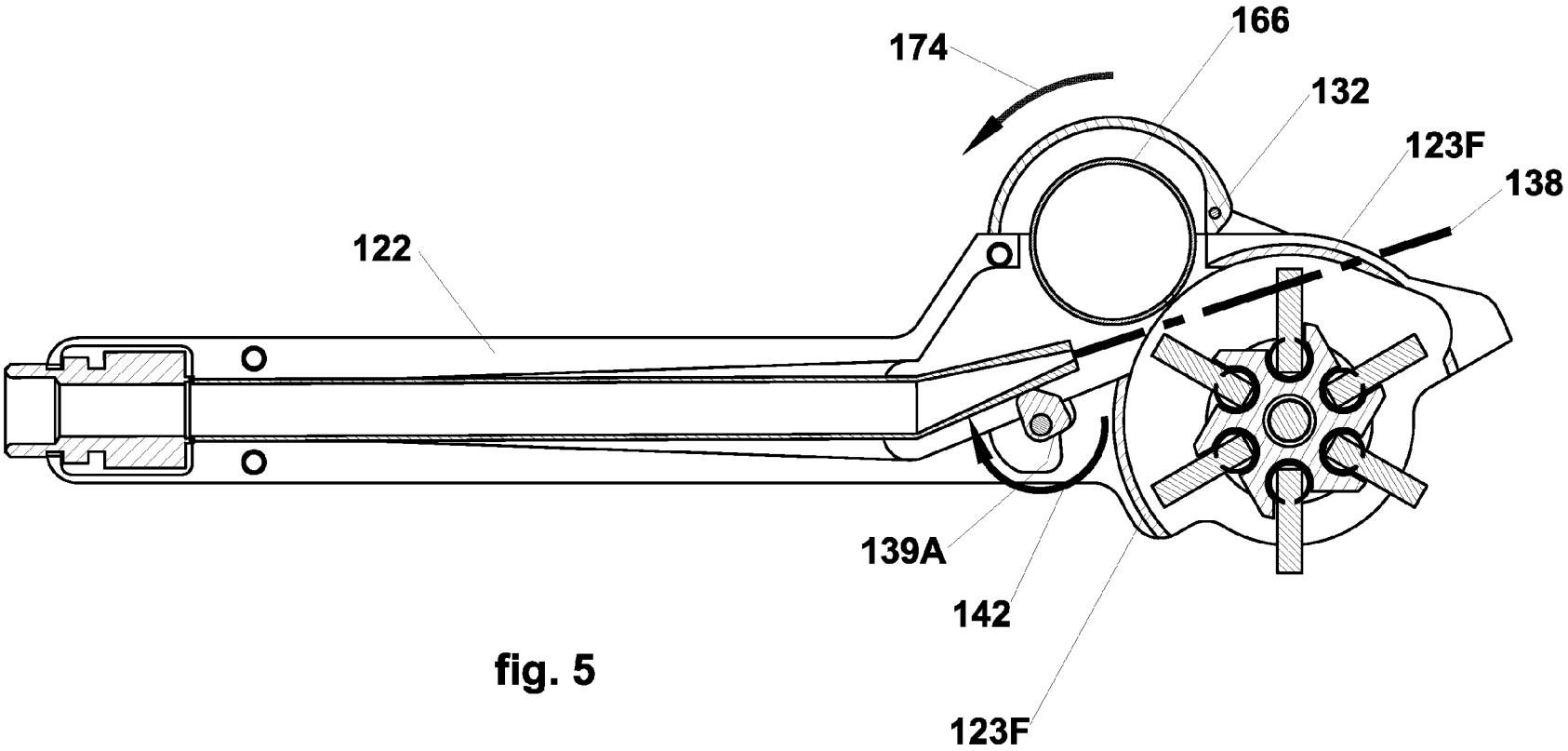
FIG. 5 is a view like FIG. 4 but with a different nozzle direction.

Referring now to FIGS. 4 and 5, and since the illustrated housing is a two-part shell-type construction, and the section plane 4-4 is at the junction of the parts, "cross hatching" of the housing in FIGS. 4 and 5 is minimal. But, there is a portion of the housing shown in FIGS. 4, 4*b*, 5 and 6 at 123F and which represents an alignment flange to assist in assembly of the two-piece housing. Referring particularly to FIG. 4, tube 134 is provided to deliver liquid from the inlet fitting 126 to nozzle 136 which has a discharge outlet 137 with a discharge direction along imaginary line 138 for fluid from the nozzle. A cam 139 is mounted to a shaft 141 which extends through the wall of the housing and is connected there to knob 127, as shown in FIG. 1. This cam is operable by manually turning the knob 127 in the clockwise direction of arrow 142 (FIG. 5) to change the nozzle discharge direction 138 from that shown in FIG. 4 to that shown in FIG. 5. The fluid delivery tube 134 is fixed to the fitting 126 so that it does not pivot at the fitting, nor does the fitting pivot in the handle 122. Therefore, the tube 134 together with the nozzle, is bent by the operation of the cam from the position shown in FIG. 4, to that shown in FIG. 5. The bending is an elastic deformation so that, if the knob is turned counterclockwise (opposite the direction of the arrow 142), the nozzle can return back to the position shown in FIG. 4. For these two extreme positions of the nozzle, there are two flats 139A and 139D on the cam, as shown in FIGS. 4 and 5, respectively. There are two additional intermediate positions which can be established for the nozzle by engaging one or the other of the two additional flats 139B and 139C. These various positions of the cam are useful to establish different rotational speeds of a treatment material dispenser cartridge 166, as will be described.

Referring further to FIG. 4, the scrubbing wheel 146 has a hub 147 mounted on two bushings 147B received on axle 129 and rotatable relative to the axle 129. The hub has a plurality of circularly spaced receptacles 148 extending axially in the hub. Each of these receptacles is part cylindrical, as shown, and receives a retainer 149 fixed to the inboard portion of a scrubbing element 151. The retainer is a split tube FIG. 21, which receives the element endwise in the split and as thus assembled and fixed together, slides endwise into the receptacle. When the hub spins with no load on it, the scrubbing elements will extend radially outward relative to the hub and axis of the shaft 129. Each of the receptacles 148 has an outer stop 152 and an inner stop 153. Since the retainer is generally cylindrical, it is able to pivot within the receptacle 148 to permit the scrubbing element to swing between the stops 152 and 153. Therefore, a discharge from the nozzle 136 in this embodiment, shown in FIG. 4 with the wheel installed as shown, will cause the wheel to rotate in the clockwise direction as indicated by arrow 154 (FIG. 4). Also, to the extent the scrubbing elements on the rotating wheel may be applied to a surface to be scrubbed, each scrubbing element 151 may pivot backward against one of the stops 153, but again deploy, due to centrifugal force as soon as the element rotates away from engagement with the scrubbed surface. Then, the element is again in an erect attitude against the stop 152. Therefore, when engaged by the fluid discharge blast from nozzle 136, the element is driven forward to continue the rotation of the wheel.

To start and increase speed of rotation of the dispenser cartridge 166, the cam can be turned in the clockwise direction away from engagement of the flat 139A with the nozzle, and stopped at engagement with the nozzle of any one of the other three flats 139B, 139C and 139D, for an increase of speed at each of these flats in succession.

Referring further to FIG. 4, the upper interior wall 156U of the housing portion is generally cylindrical directly above the wheel 146. But it blends into a relatively flat surface 157 tangent to the cylinder at the portion which extends forward and downward to a reverse curve 158, which ends at 159 immediately above the scrubber front opening 161. This curved surface 158 redirects the fluid moving around the inside of the housing along with the scrubbing elements and down in the direction of the surface at the edge 159 where the fluid is directed toward the descending scrubbing elements at that location as shown in FIG. 4 by the arrow 162. Therefore, remaining energy in the fluid continues to be used in turning the wheel, thus, increasing the power applied while reducing lost energy which could otherwise occur by unnecessary water spraying out of the front of the wheel housing onto the surface being scrubbed.

Figure 4A:
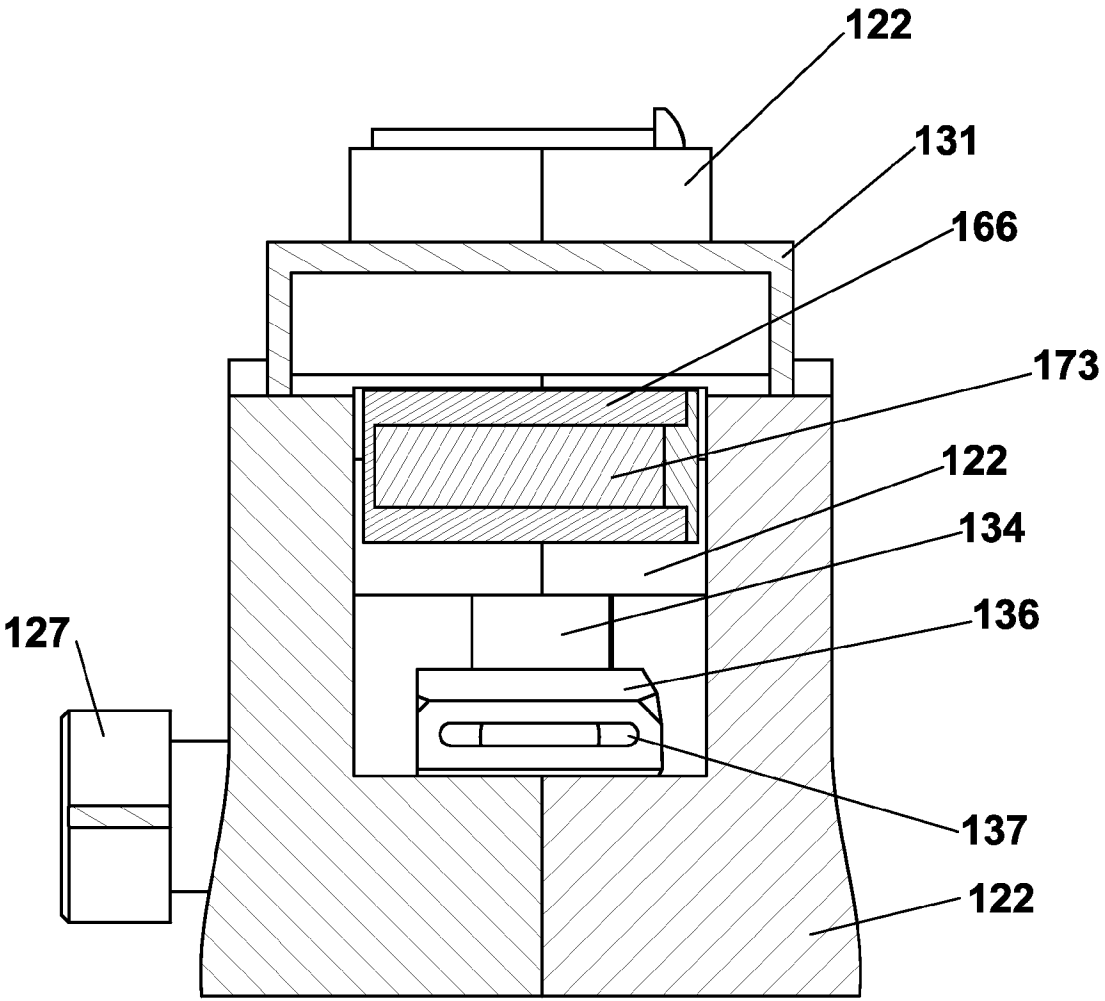
FIG. 4*a* is a cross-section taken at line 4*a*-4*a* in FIG. 4 and viewed in the direction of the arrows.
Figures 4B, 21:
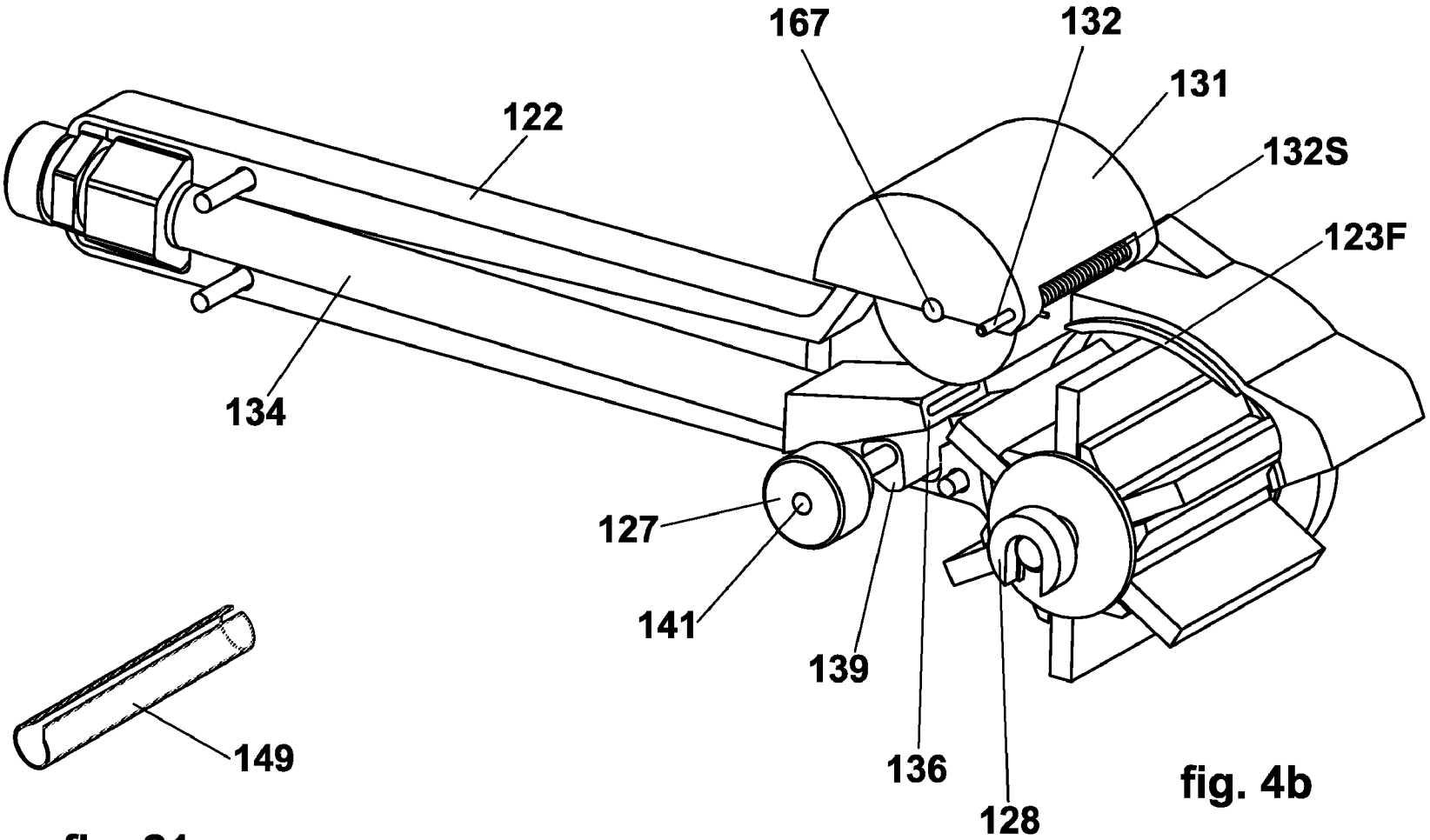
FIG. 4*b* is a perspective cut-away view thereof, looking toward the distal end.
FIG. 21 is a perspective view of a treatment element retainer tube.
Figure 4C:
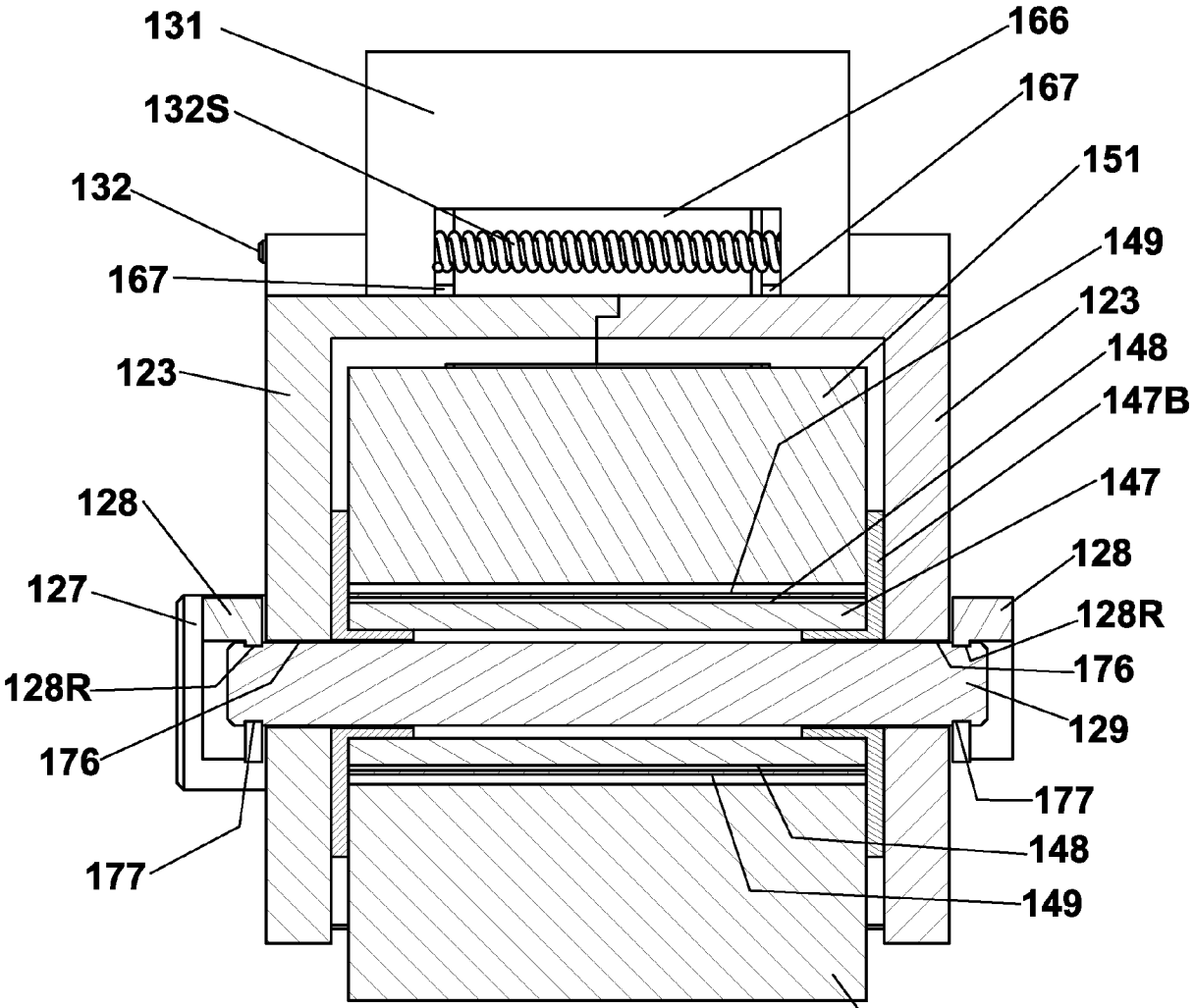
FIG. 4*c* is a cross-section taken at line 4*c*-4*c* in FIG. 4 and viewed in the direction of the arrows.
Figure 6:
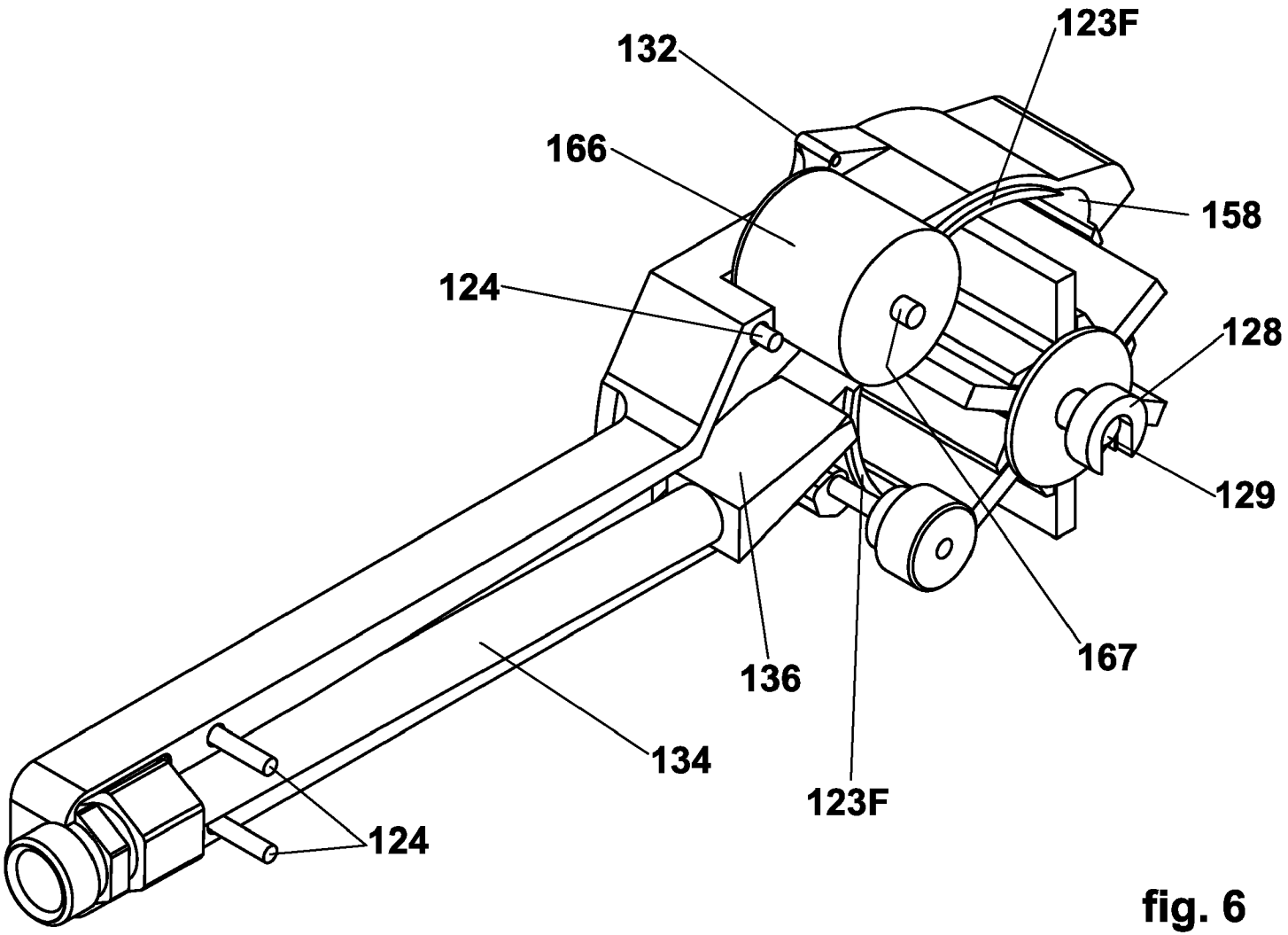
FIG. 6 is a cut-away view thereof in perspective looking toward the proximal end.
Figure 7:
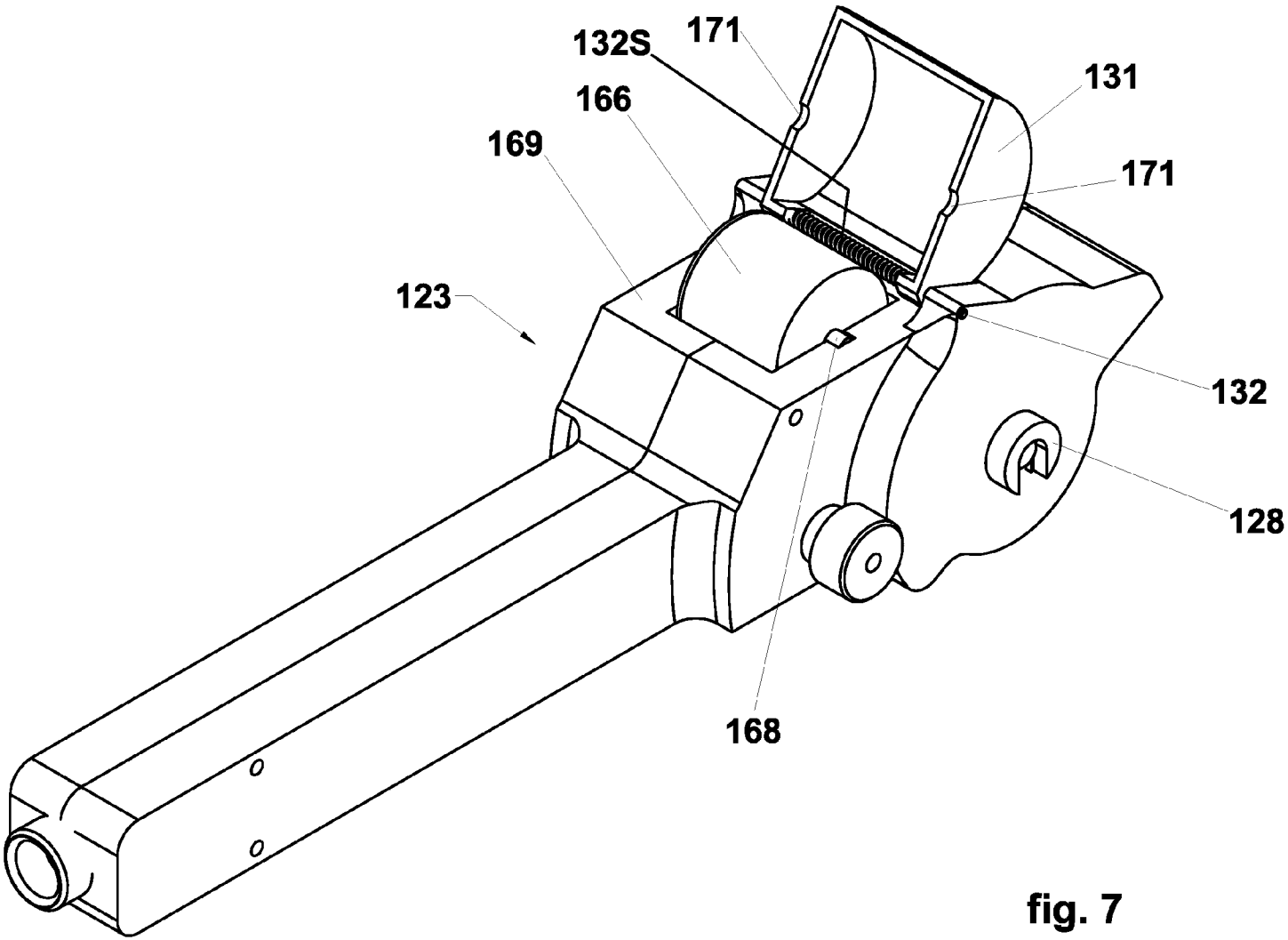
FIG. 7 is a perspective view thereof showing the liquid dispenser cartridge cover opened.
Figure 8:
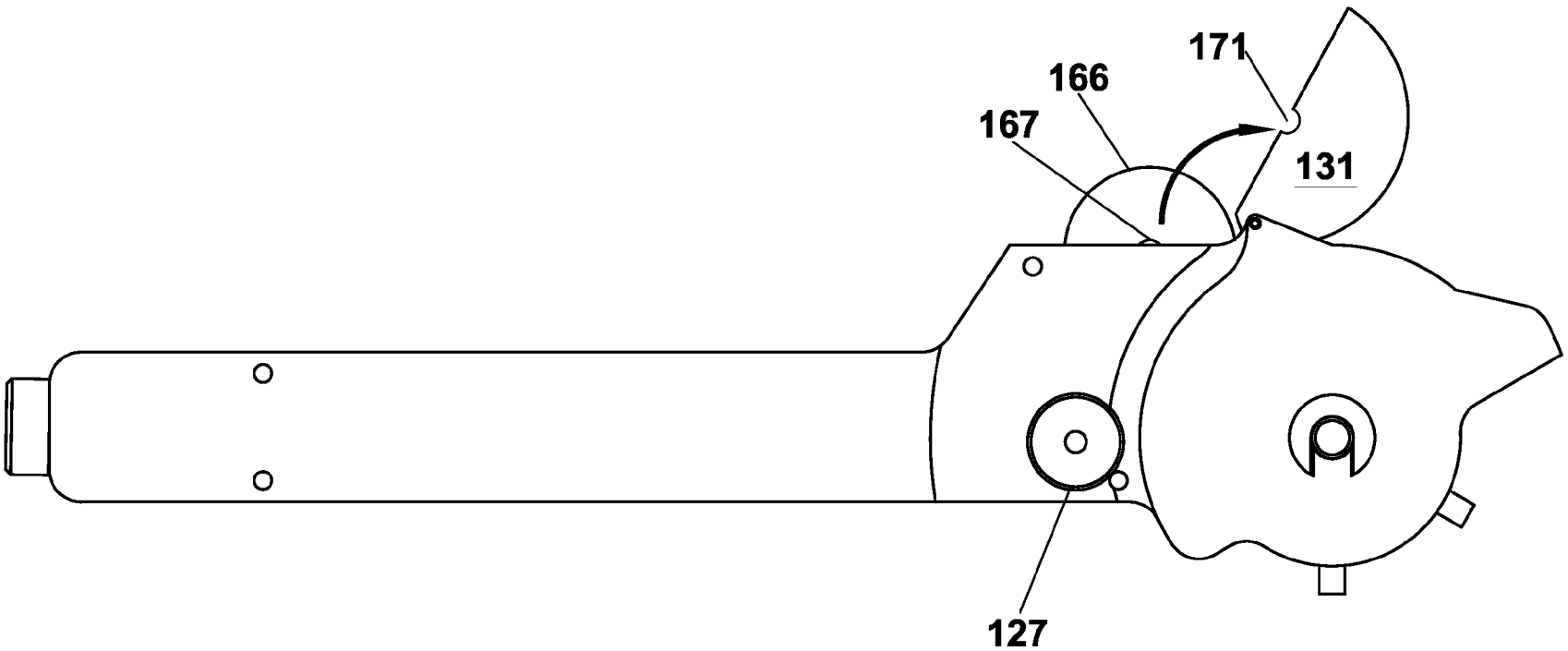
FIG. 8 is a side elevation view thereof.
Figure 9:
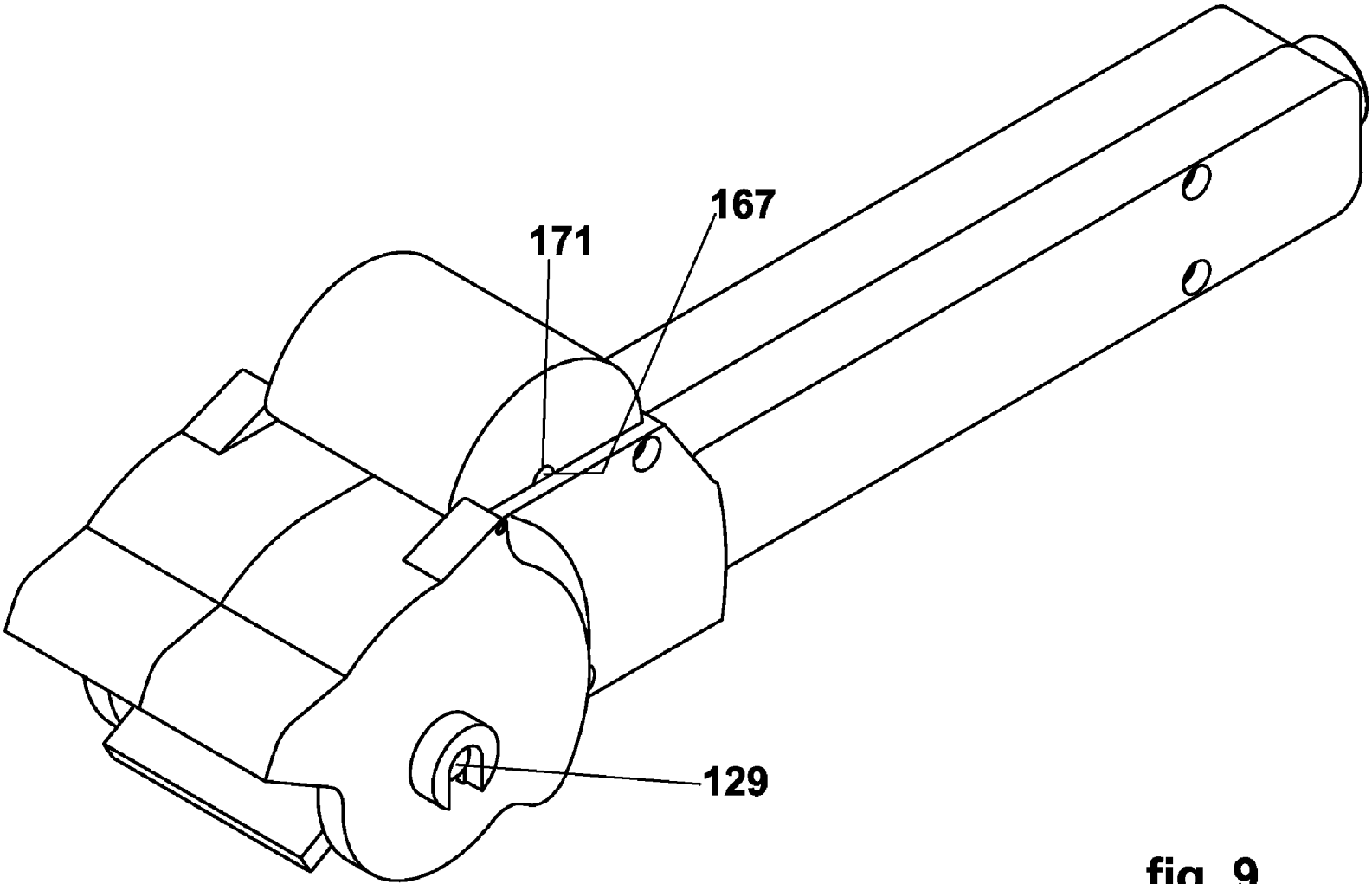
FIG. 9 is a perspective view thereof with the cover closed and looking toward the distal end of the portable scrubbing apparatus of FIGS. 1 through 8.
Figure 10:
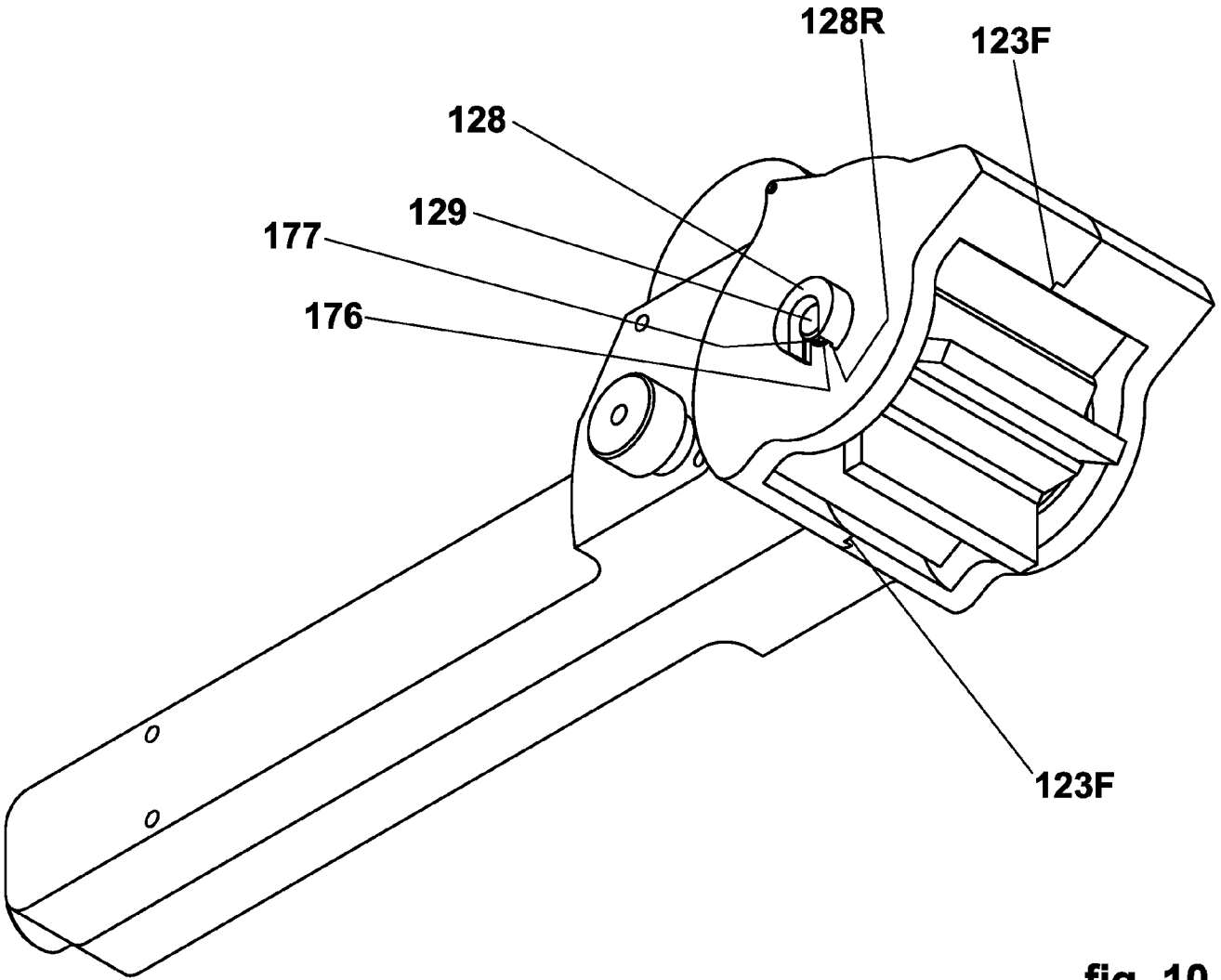
FIG. 10 is a perspective view of the embodiment of FIGS. 1 through 9 looking upward toward the distal end.

Referring now to FIGS. 4 through 9, a treatment material dispenser is shown in the form of a replaceable cylindrical cartridge 166 which has axle stub pins 167 which extend out both ends and are received in upwardly opening circular notches 168 (FIG. 7) in the top surface 169 of the housing portion 123. The cover 131 is normally closed over the cartridge and has downwardly opening circular notches 171 providing upper bearings for the axle pins 167 so that, when the lid is closed, the lower and upper notches 168 and 171, respectively, provide end bearings for support and rotation of the cartridge 166. As previously mentioned, the cover is pivotable on hinge 132 and is spring-loaded so that it normally is held in the closed position by a coil spring 132S wound around the hinge pin 132 as shown in FIGS. 4*c* and 7.

As shown in FIG. 4 and the other sectional views, the cartridge has a small opening 172 in the wall thereof providing an opportunity for a liquid treatment material 173 in the cartridge to escape if there is sufficient centrifugal force due to spinning of the cartridge. As an example, the opening may be a port about 0.015 inches in diameter. Some other shape or size, or multiple openings, might be used. When the nozzle is placed in the highest angle of discharge, as shown in FIG. 5, there is enough spray touching the surface of the cartridge to make it spin rapidly in the counterclockwise direction of arrow 174. As it does so, it dispenses the liquid from the cartridge into the scrubber wheel portion of the housing for mixing with the fluid applied to the scrubbing elements and to the surface of whatever is being scrubbed. In contrast, with the cam turned so that the nozzle is resting on the low face 139A of the cam, in the position of the nozzle shown in FIG. 4, there is virtually no portion of the spray discharge from the nozzle against the cartridge, so the cartridge can stop rotating and thereby stop dispensing liquid treatment material. With the cam in the position shown in FIG. 5, the high face 139D of the cam is supporting the nozzle, and there is maximum dispensing of the liquid treatment material. Cam faces 139B and 139C may be used to provide speeds intermediate the cartridge at rest and the maximum cartridge speed.

As shown in FIG. 6, although the tube 134 is shown cylindrical, it can be or have any cross-sectional shape or have a transition portion of any cross-sectional shape to the nozzle inlet. The nozzle portion may be more rectangular so that the outlet 137 may be a generally rectangular slot, if desired. While the nozzle may be the full width of the interior of the housing or the wheel, it is not necessarily the full width as is shown in FIG. 4*a*.

Referring again to FIG. 4*c*, to facilitate replacement of the scrubbing wheel, the axle 129 extends entirely through the housing portion 123 and the hub 147. The hub is rotatable relative to the axle so that the axle can, if desired, remain stationary in the axle receiving holes 176 in both sides of the housing portion. The axle has a circular groove 177 in each end portion (FIGS. 4*c* and 10) and is retained in the housing by a rib 128R of the retaining clip 128 at each side of the housing. Therefore, if it is desired to replace the wheel, the clips on one or both sides are removed, the axle is pulled out and the wheel can be simply dropped out of the opening in the bottom of the housing. A new wheel can be installed by simply reversing the procedure. If desired, one end of the axle can have a head or integral flange on it, and the groove and clip only on the other end. In that case, the clipped end on one side is unclipped, and the axle is pulled out the other side to release the wheel.

The treatment material in the cartridge may be a soap, detergent, polish, wax, or other material appropriate for the intended effects of the tool.

Figure 11:
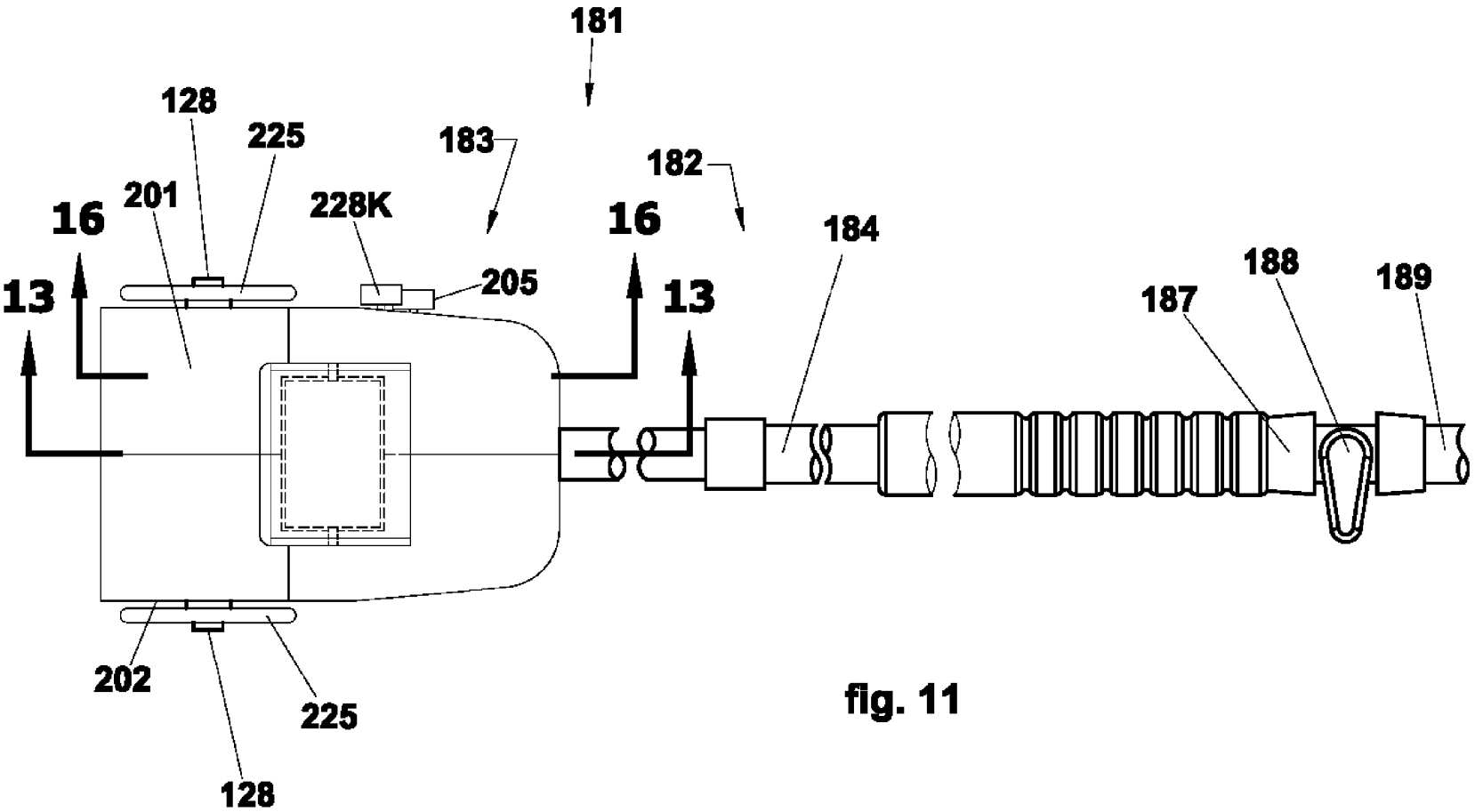
FIG. 11 is a top plan view on a smaller scale of another embodiment with some different water discharge features, with a portion broken out of the handle to conserve space in the drawing.

Referring now to FIG. 11 and following, another embodiment of the scrubber assembly is disclosed. In this embodiment, the scrubber assembly 181 includes a handle portion 182 and housing portion 183. The handle portion is a generally conventional tube 184 having threads at one end received into the threaded socket 186 in the housing portion and having a fitting 187 at the proximal end capable of receiving a conventional garden hose valve assembly 188 connected to a garden hose 189. Accordingly, this scrubber is readily adapted to use with the conventional garden hose for propelling a scrubber wheel and a treatment material cartridge. It should be understood that other sources of supply of pressurized liquid for mobilizing a scrubber wheel and/or carrying a liquid treatment material may be used. The scrubber wheel 191 has a hub 192 mounted for rotation on axle 193. It has a plurality of circularly spaced receptacles 194 receiving scrubbing elements 196 including retainers 197 and treatment elements 198. As in the previously described embodiment, the scrubber wheel can be removed from the housing by removing a clip 128 from one end of the axle and pulling the axle through the holes in the left and right hand sides of the housing. Then the scrubber wheel can be simply pulled or dropped out of the front opening in the housing. A new scrubber wheel can be installed in the reverse manner by simply placing it in the opening and pushing the axle back through the holes in the housing and applying the spring clip to the slotted end of the axle.

The scrubber wheel, when outside the housing, can have the treatment elements replaced by simply pulling them axially out of the receptacle slots and replacing them with new ones. When the wheel is installed back again in the housing, the inside faces of the housing side walls 201 and 202 or bushings such as 147*b* (FIG. 4*c*) will prevent the treatment elements from moving axially in the receptacle slots 197. Other means for doing so could be employed readily if desired. Of course, they are able to pivot as described above with reference to the previously described embodiment.

Figure 13:
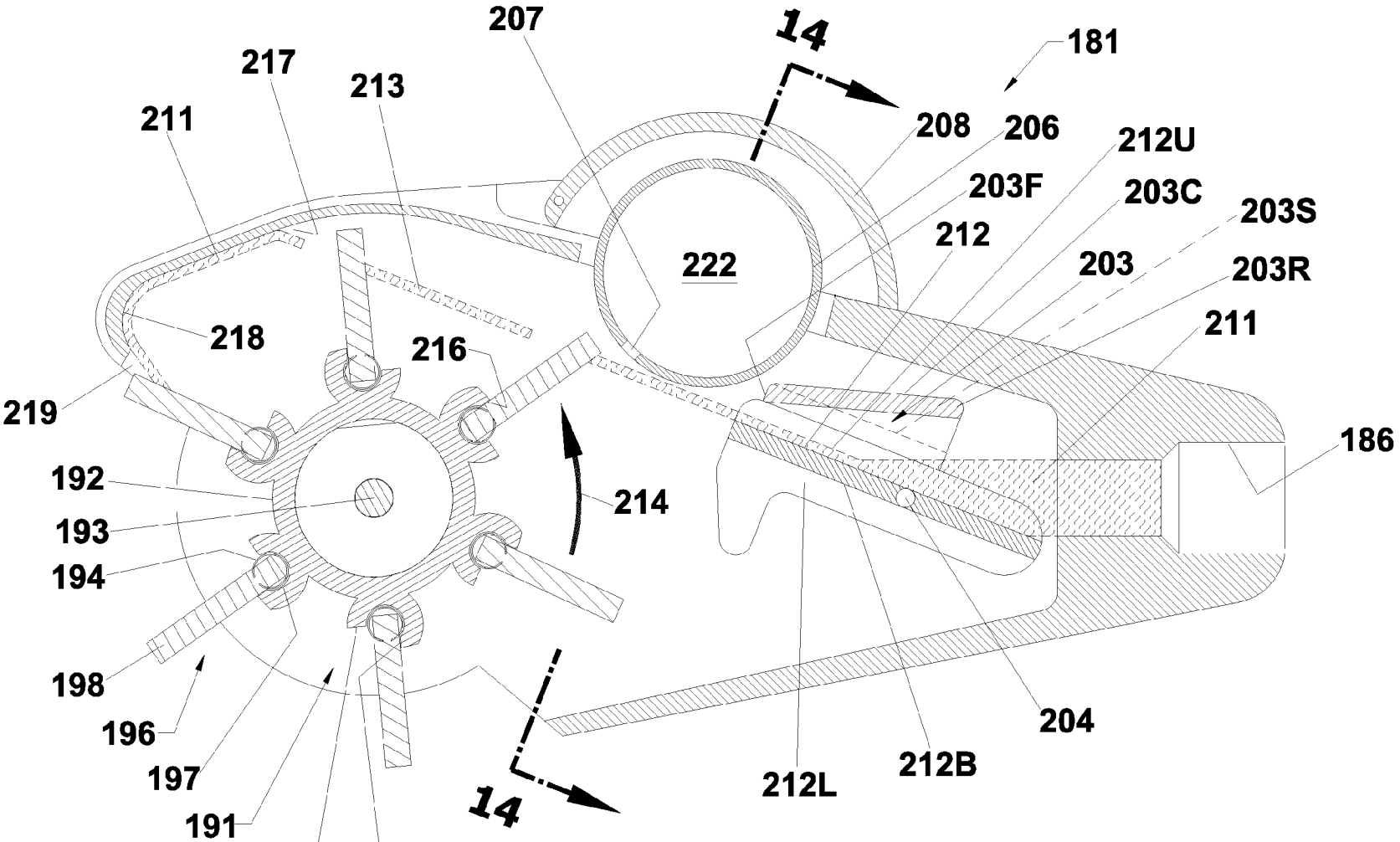
FIG. 13 is an enlarged section through a distal portion of this embodiment taken at line 13-13 in FIG. 11 and viewed in the direction of the arrows.
Figure 14:
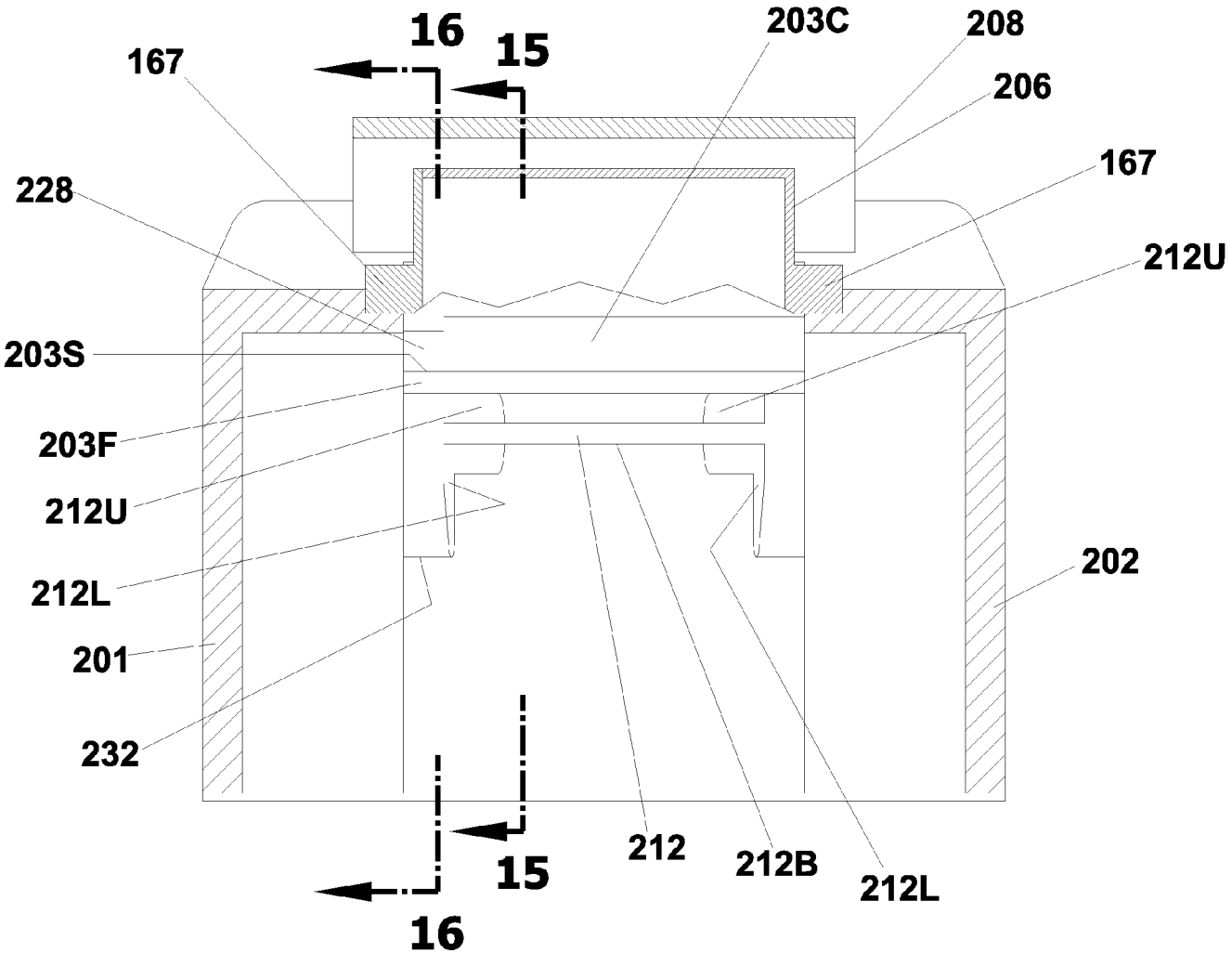
FIG. 14 is a cross-section thereof taken at line 14-14 in FIG. 13 and viewed in the direction of the arrows.
Figure 17:
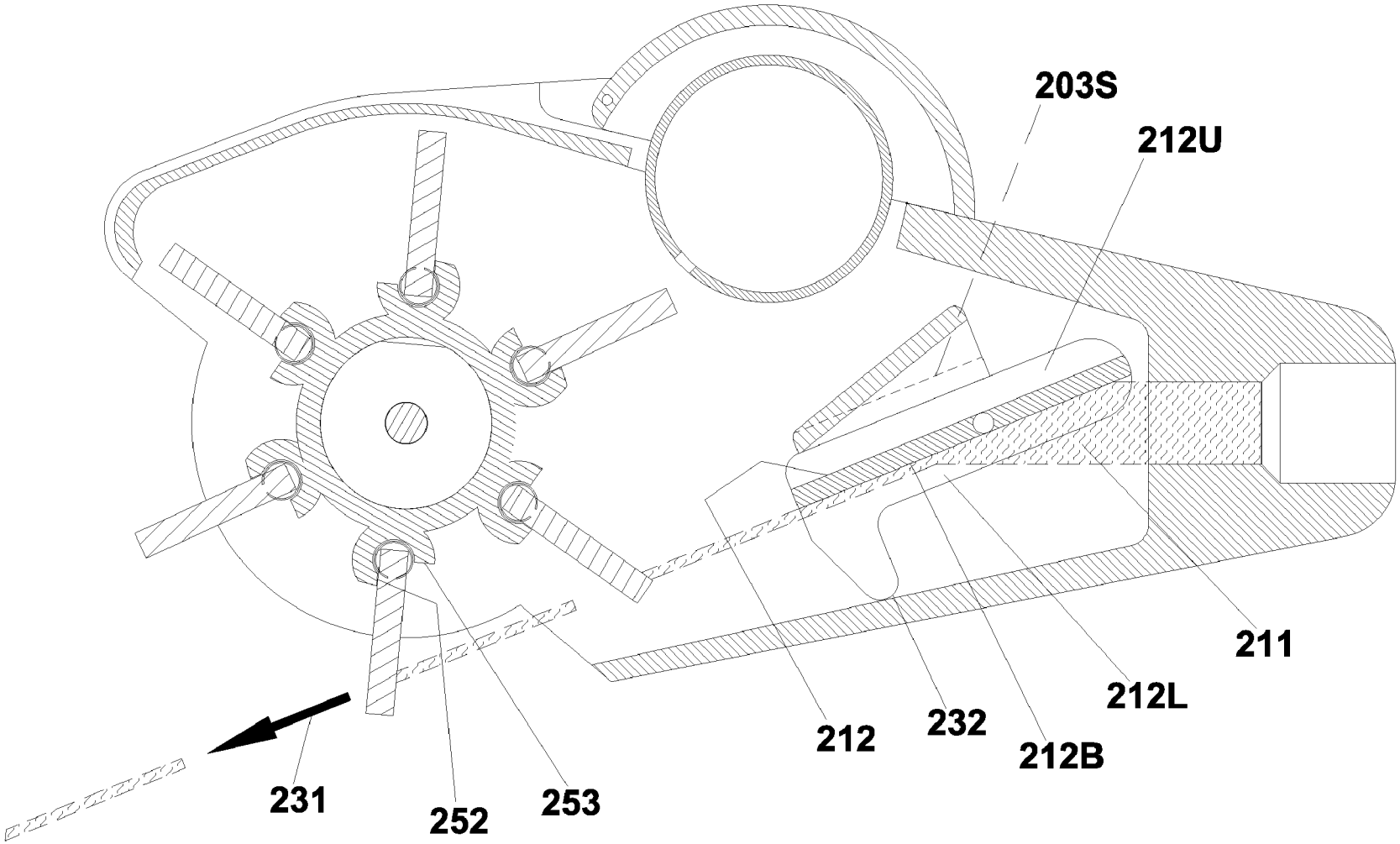
FIG. 17 is a view similar to FIG. 13 but showing the scrubber wheel and water discharge plate in a different attitude.

To direct the flow of pressurized water or other fluid introduced to the handle 184, there is a nozzle 203 pivotally mounted on an axle 204 in housing so that it is operable between a position shown in FIG. 13 and a position shown in FIG. 17. There is also a treatment material cartridge 206 mounted in the housing in the same manner as the cartridge 166 is mounted in the housing of the previously described embodiment. The cartridge also has an outlet aperture 207 (FIG. 13), and the cartridge is normally covered with the lid 208 hinged to the housing.

In the position shown in FIG. 13, the nozzle redirects the pressurized fluid 211 entering from the handle 184, upward on the deflector wall 212 of the nozzle in a discharge direction 213 which engages the face of each of the treatment elements 198 adjacent the outer portion of each of the treatment elements, causing rotation of the wheel in the direction of the arrow 214. The high stop 216 on the wheel keeps the treatment element erect so that the fluid blast from the deflector wall along the line 213 produces a strong rotational force on the wheel.

As the scrubbing wheel spins, and the driving fluid 211 departs off the end of the treatment elements, the fluid strikes the inside face of the upper wall 217 of the housing and is deflected downward and into a reverse curve surface at the inside 218 of the front of the housing above the outlet 219. At the upper edge of the outlet, the direction of the remaining blast is downward and rearward against the face of the treatment element moving downward away from the top of the opening, providing additional thrust to the wheel for rotation in the direction of arrow 214. As in the previously described embodiment, the treatment element is able to pivot backward as it strikes the surface of whatever is being treated by the scrubbing machine. As soon as it departs that surface, it again moves outward under centrifugal force and ready for impact by the fluid stream along line 213 when the treatment element moves upward and forward in the housing as the wheel rotates forward in the direction of arrow 214.

Figure 15:
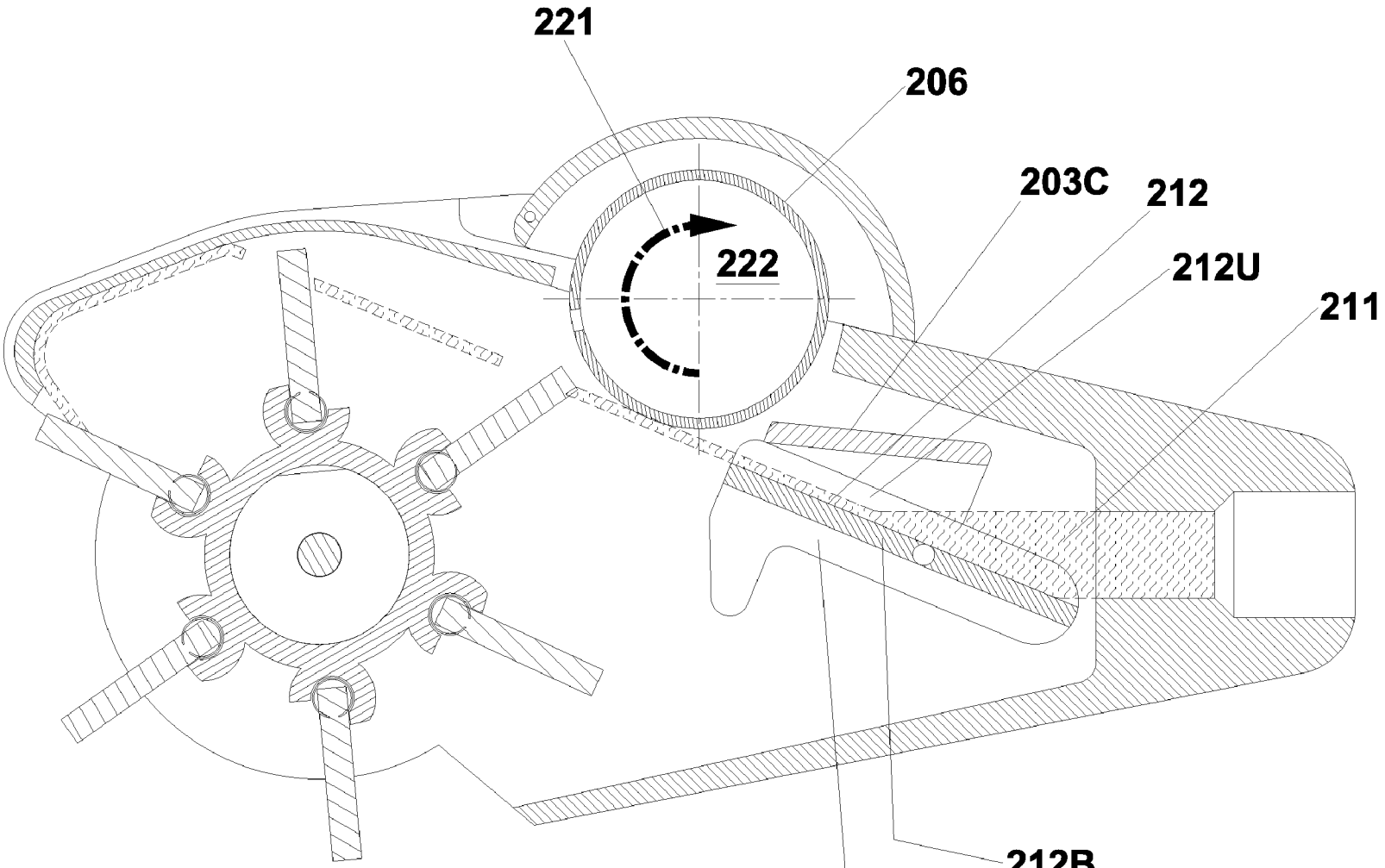
FIG. 15 is a section taken at line 15-15 in FIG. 14, viewed in the direction of the arrows and showing a change in operating state from that in FIG. 13.

To cause the treatment material dispenser cartridge to spin to discharge treatment material into the flow of fluid from the deflector wall 212, it is only necessary to tip the nozzle slightly clockwise to move the fluid discharge stream 213 of the nozzle from close proximity to the cartridge surface as in FIG. 13, to contact with the cartridge surface as in FIG. 15, where the stream engaging the perimeter of the cartridge spins the cartridge in the clockwise direction of arrow 221. The speed of rotation and the consequent amount of treatment material 222 discharged from the cartridge, will depend on how the fluid is striking the periphery of the cartridge.

Figure 12:
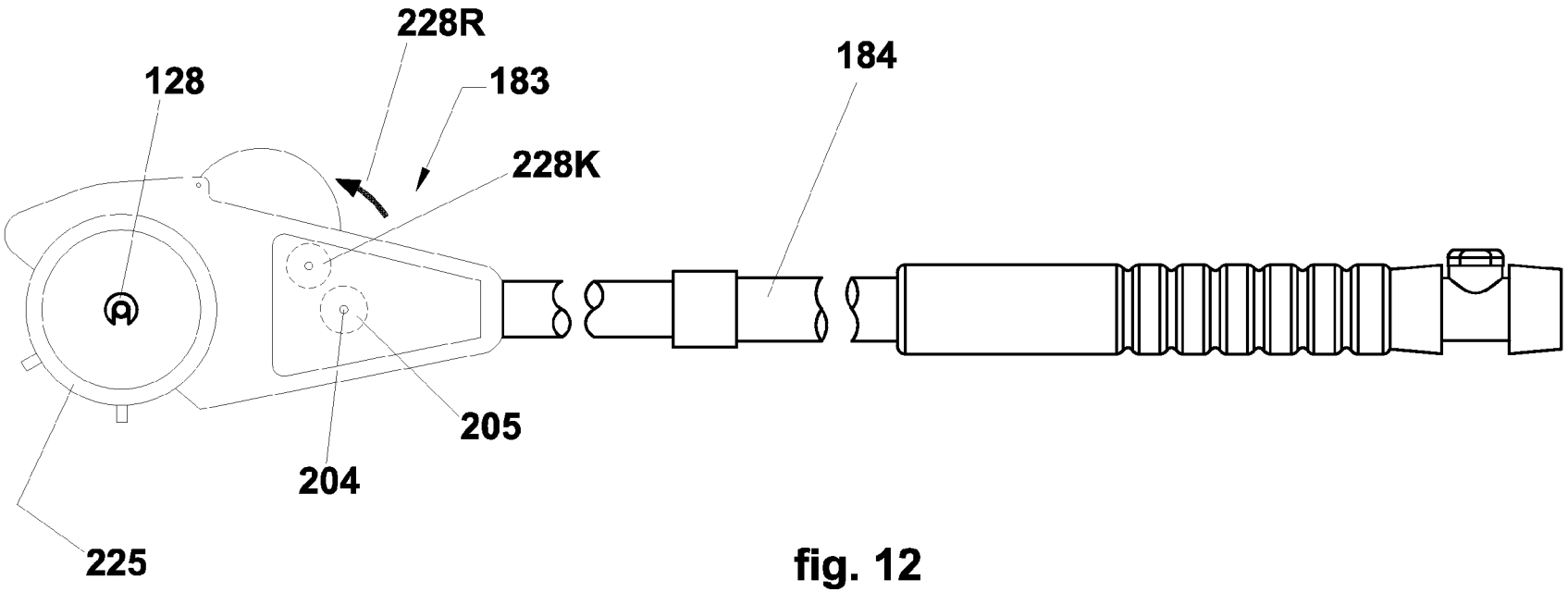
FIG. 12 is a side elevation view thereof.

Referring back to FIGS. 11 and 12, wheels 225 are mounted on axle 129 and held on by clips 128. These can be used conveniently as tires to rest and roll along the surface of an automobile being treated. They are bushed on the axle similar to the scrubber wheel mounting on the axle to turn relative to the axle, so the axle can be snug and need not turn in the mounting holes in the housing. It is preferable that the perimeter of the wheels be a flexible material of low friction to avoid a tendency to stick or otherwise scuff the surface being treated. Polyethylene has been found suitable, but other materials may serve as well.

Figure 16:
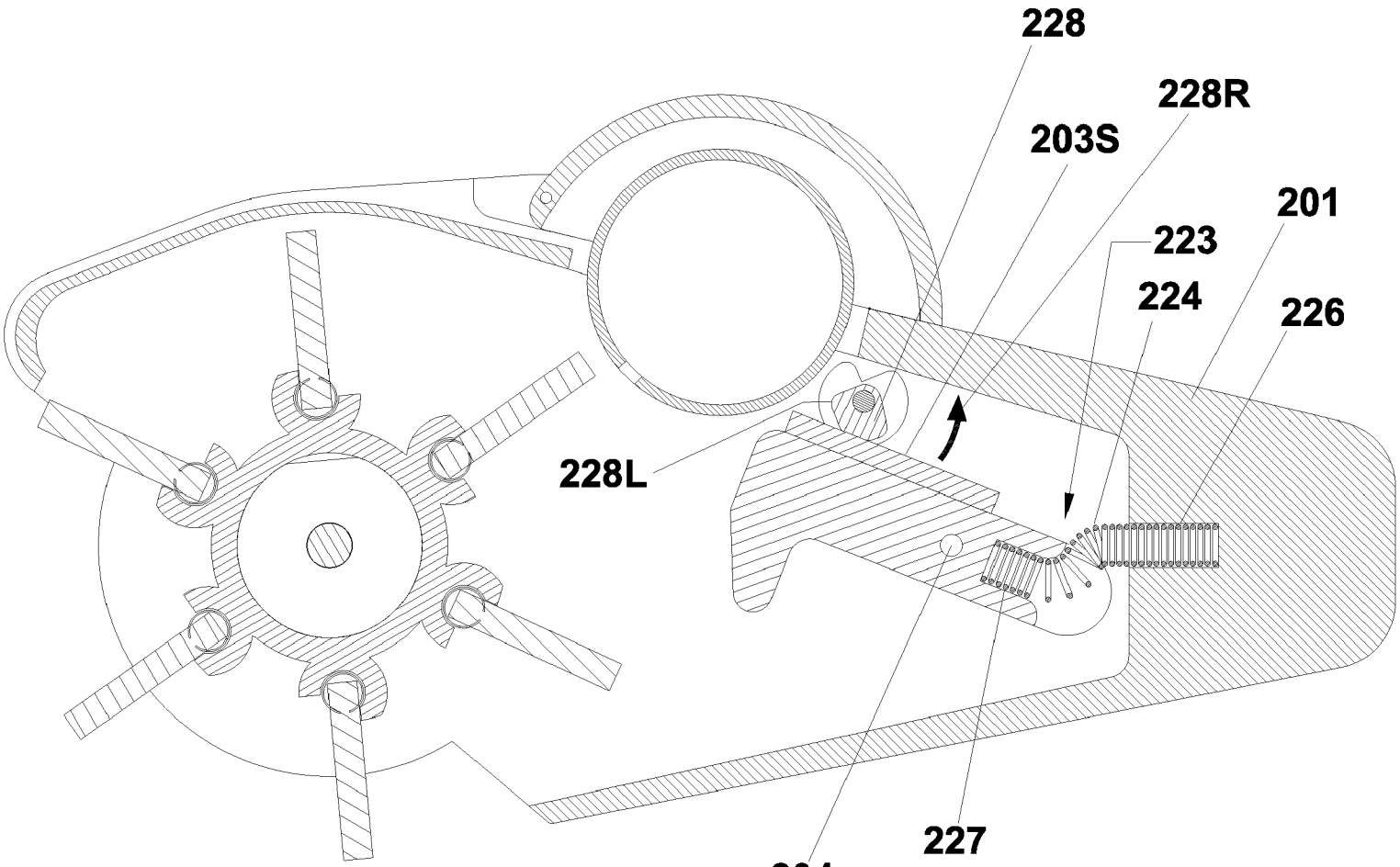
FIG. 16 is a section taken at line 16-16 in FIGS. 11 and 14 viewed in the direction of the arrows and showing the water discharge plate position stabilizer spring.
Figure 20:
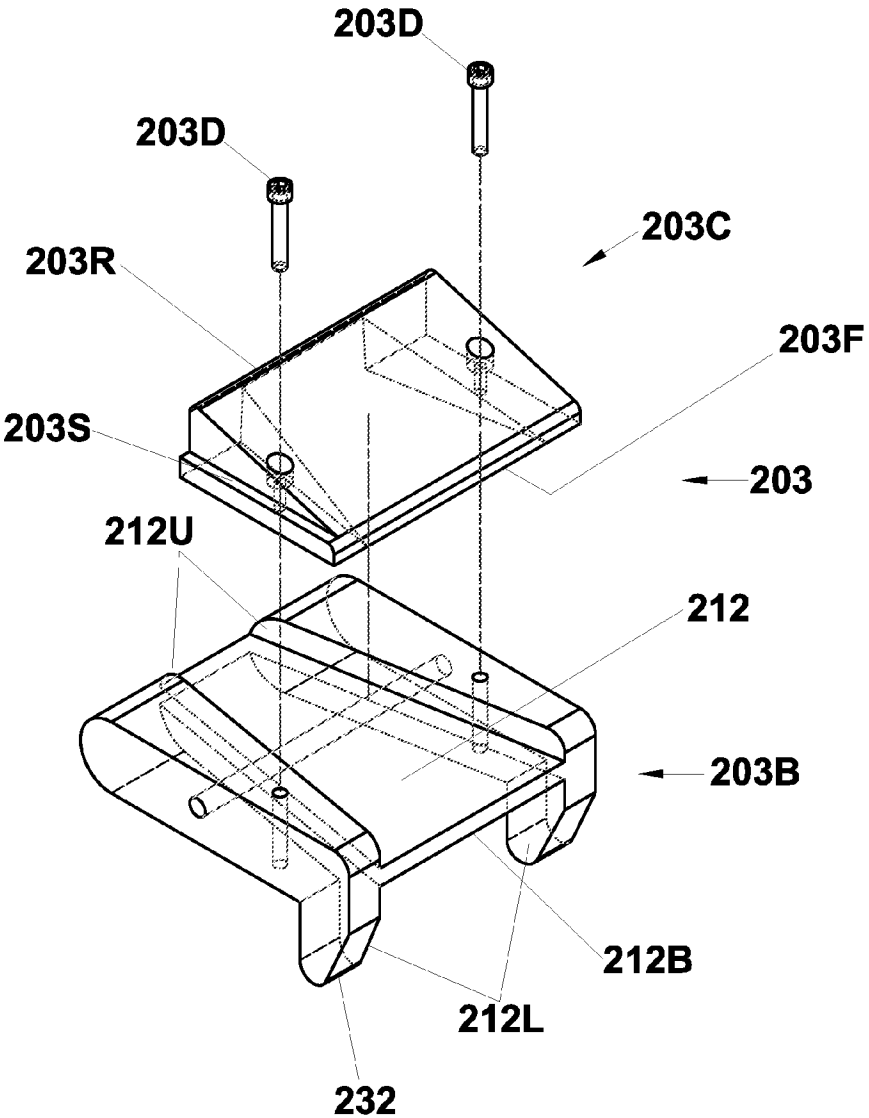
FIG. 20 is an exploded view of the nozzle deflector plate and deflector cap.
Figure 22:
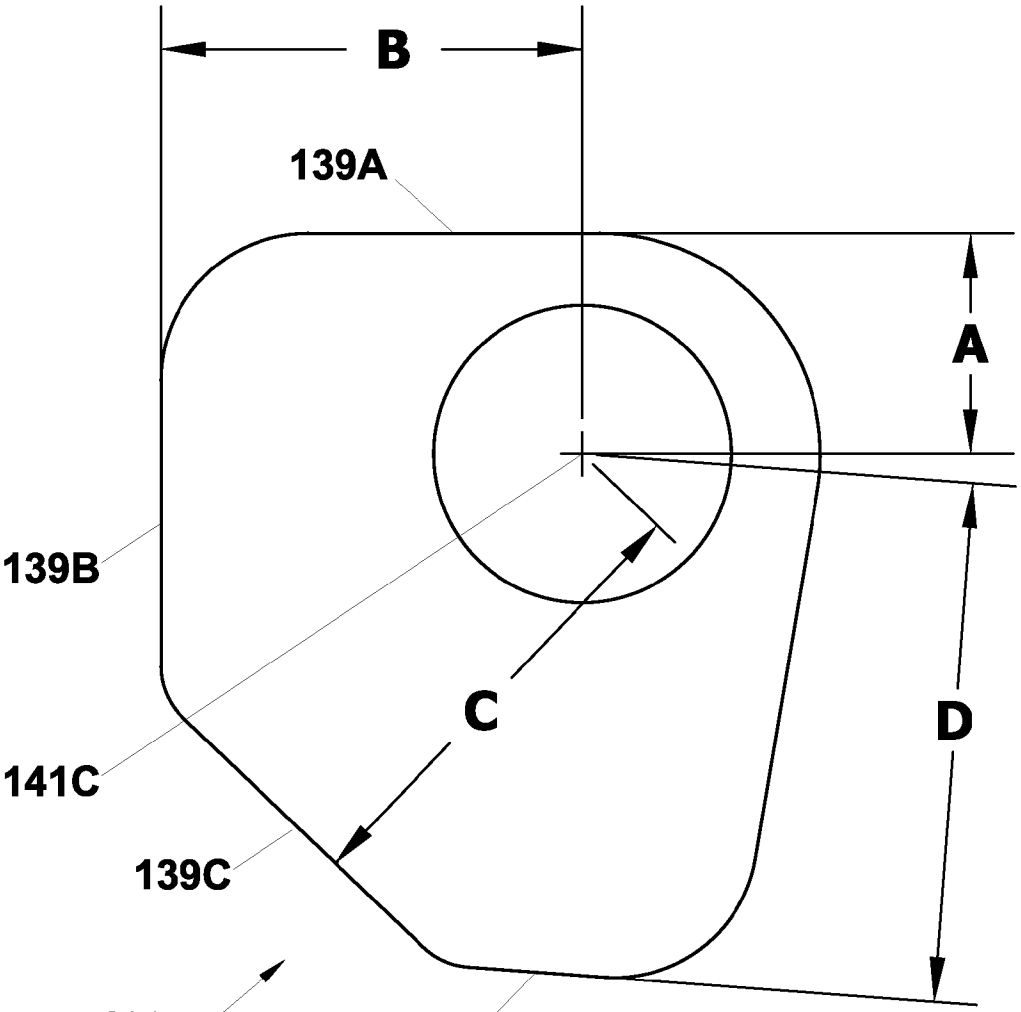
FIG. 22 is an enlarged side view of a nozzle-direction control cam of the first, FIG. 4, embodiment.
Figure 23:
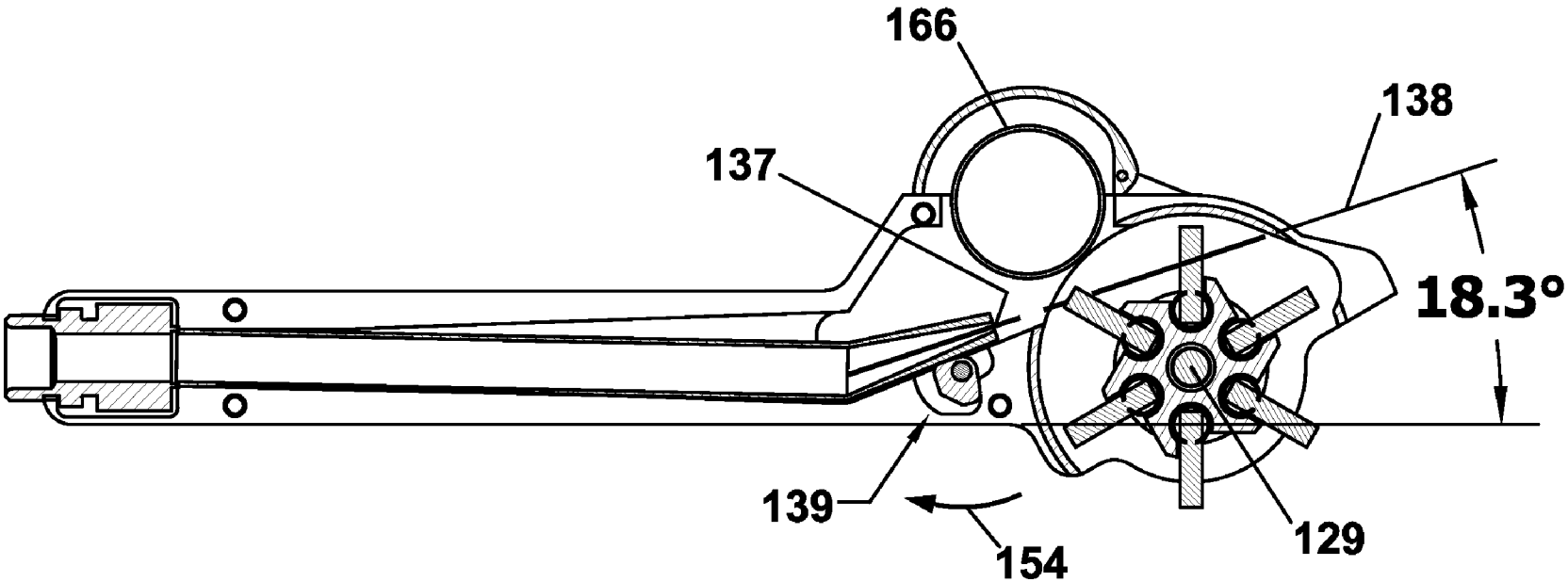
FIGS. 23-26 are views like the FIG. 4 first embodiment but fragmentary, and showing four different cam orientations providing four different nozzle angles.
Figure 24:
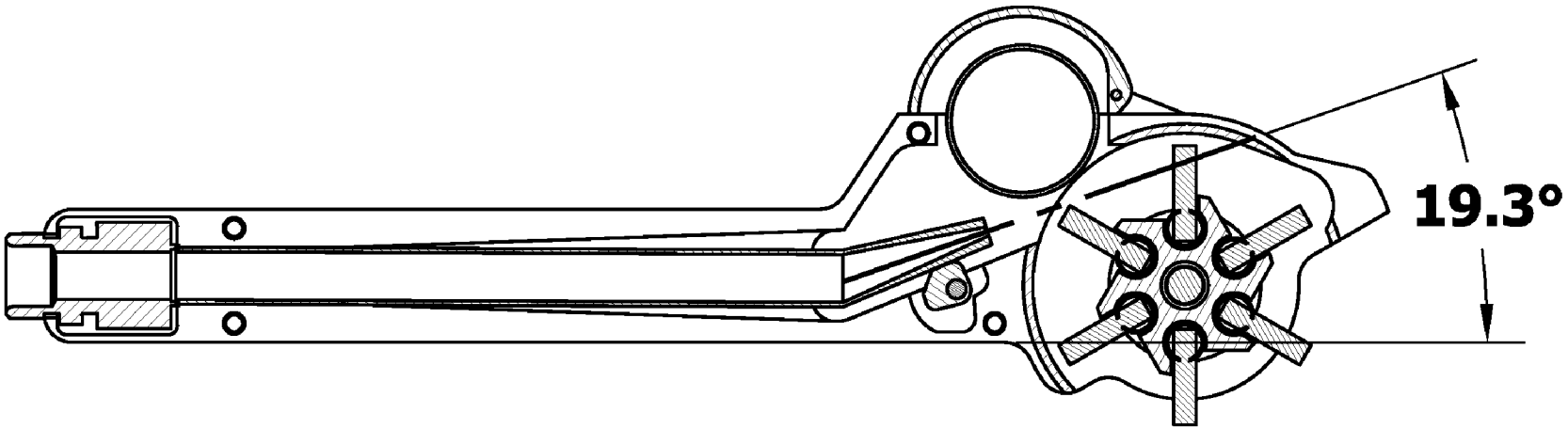
Figure 25:
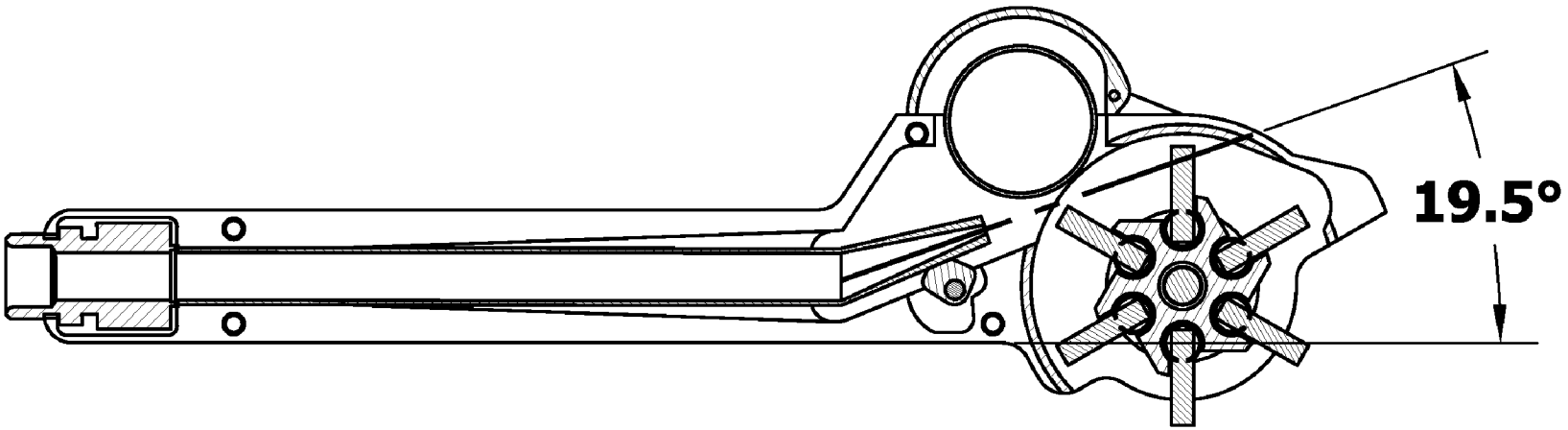
Figure 26:
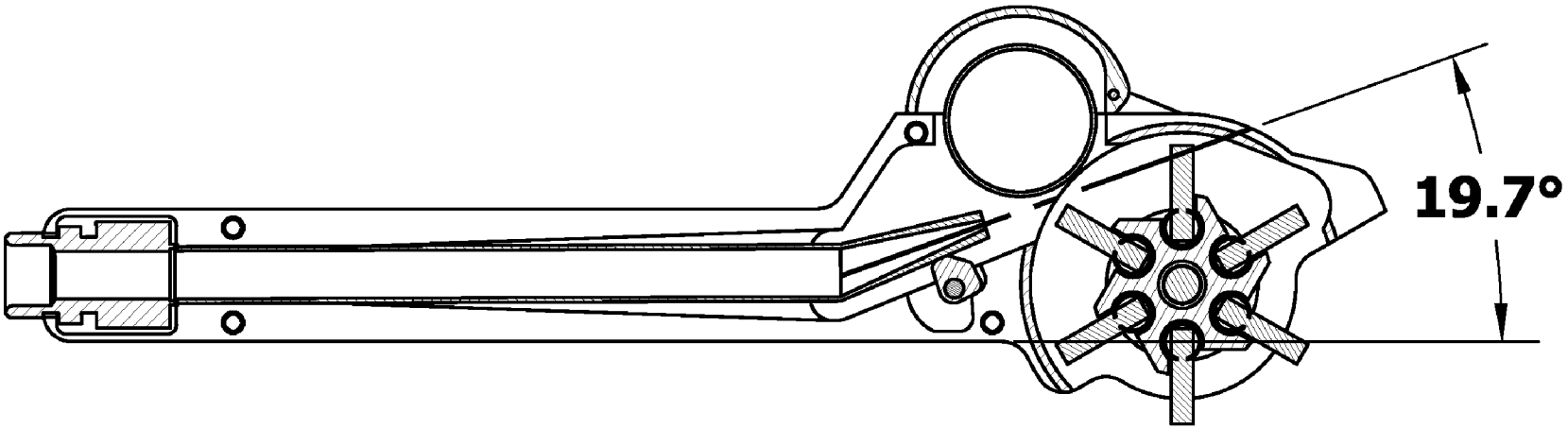
Figure 27:
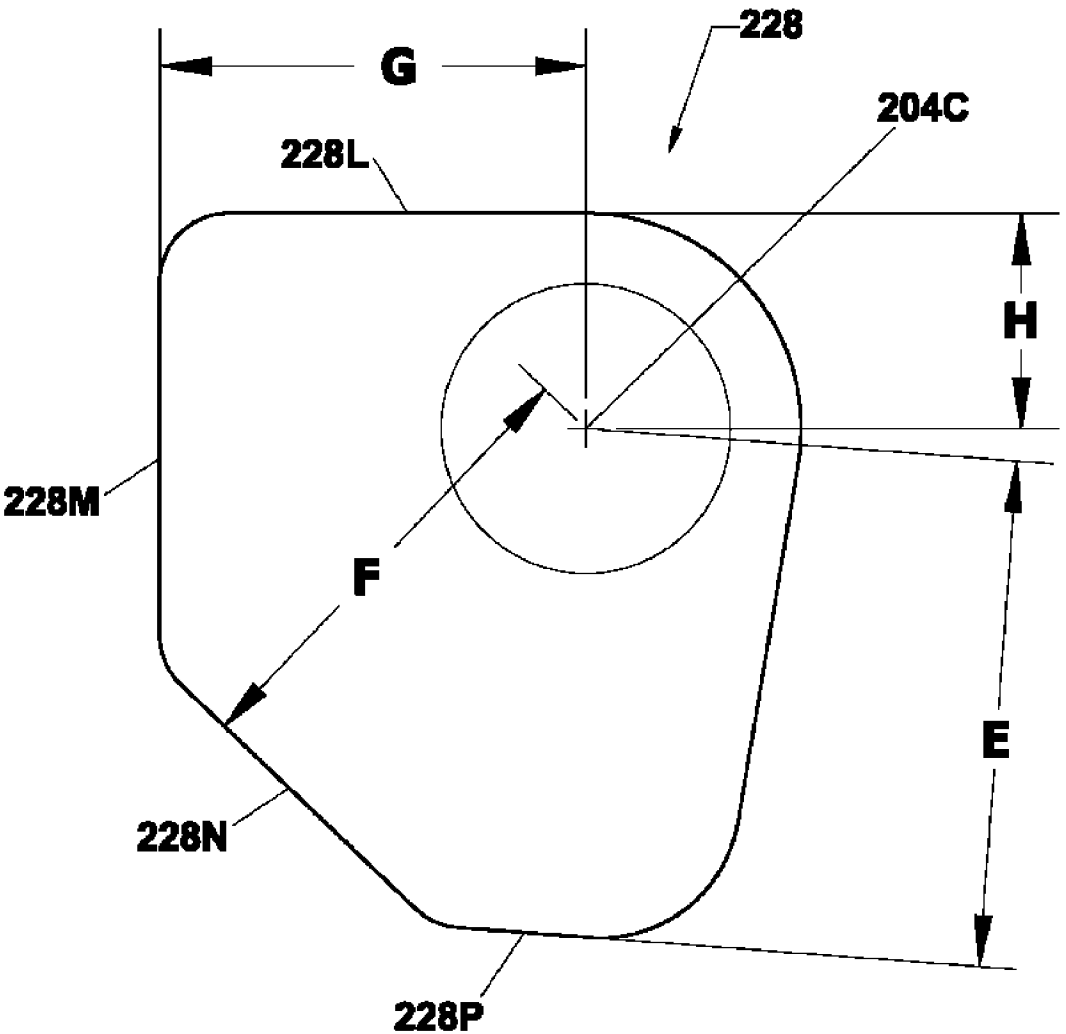
FIG. 27 is an enlarged side view of a nozzle-direction control cam for the second, FIG. 15, embodiment.
Figure 31:
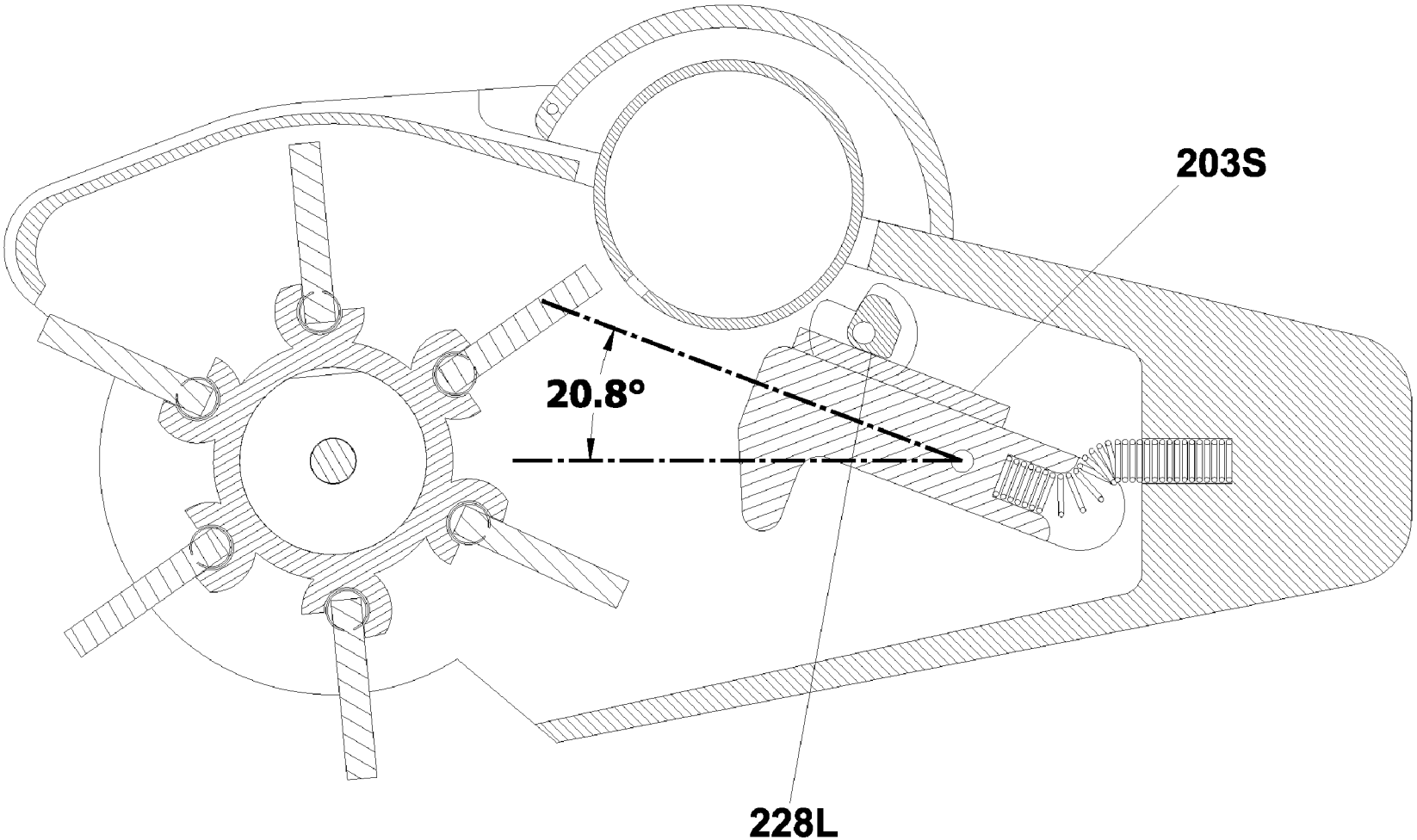

Referring now to FIGS. 16 and 20, cam 228 engages ledge 203S on the nozzle, holding the nozzle in the position shown in FIGS. 13 and 16. The nozzle stabilizer 223 includes a spring 224 which has one end received in the socket 226 in the housing and the other end received in a socket 227 in the nozzle. Both sockets are in plane 16-16, laterally offset from the center of the housing. This spring will hold the nozzle against the cam 228 in the attitude shown in FIG. 16. Turning the cam control knob 228K slightly in the direction of arrow 228R (FIG. 16) will place a lower face 228L of the cam against ledge 203S of the nozzle, permitting the spring to tilt the nozzle to the position of FIGS. 15 and 31 and spin the cartridge.

Figure 28:
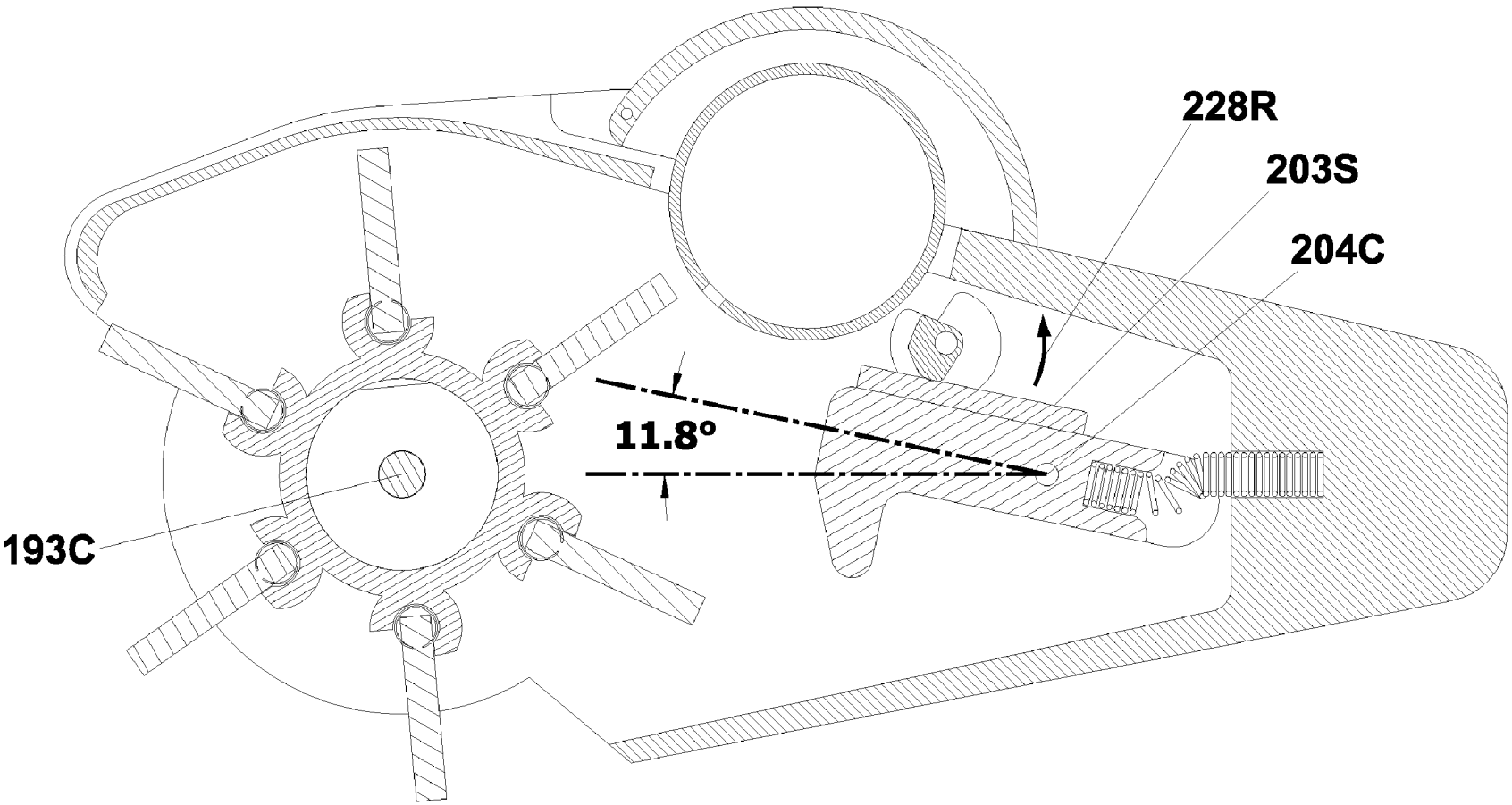
FIGS. 28-31 are views like the FIG. 13 second embodiment but fragmentary, and showing four different cam orientations providing four different nozzle angles.
Figure 29:
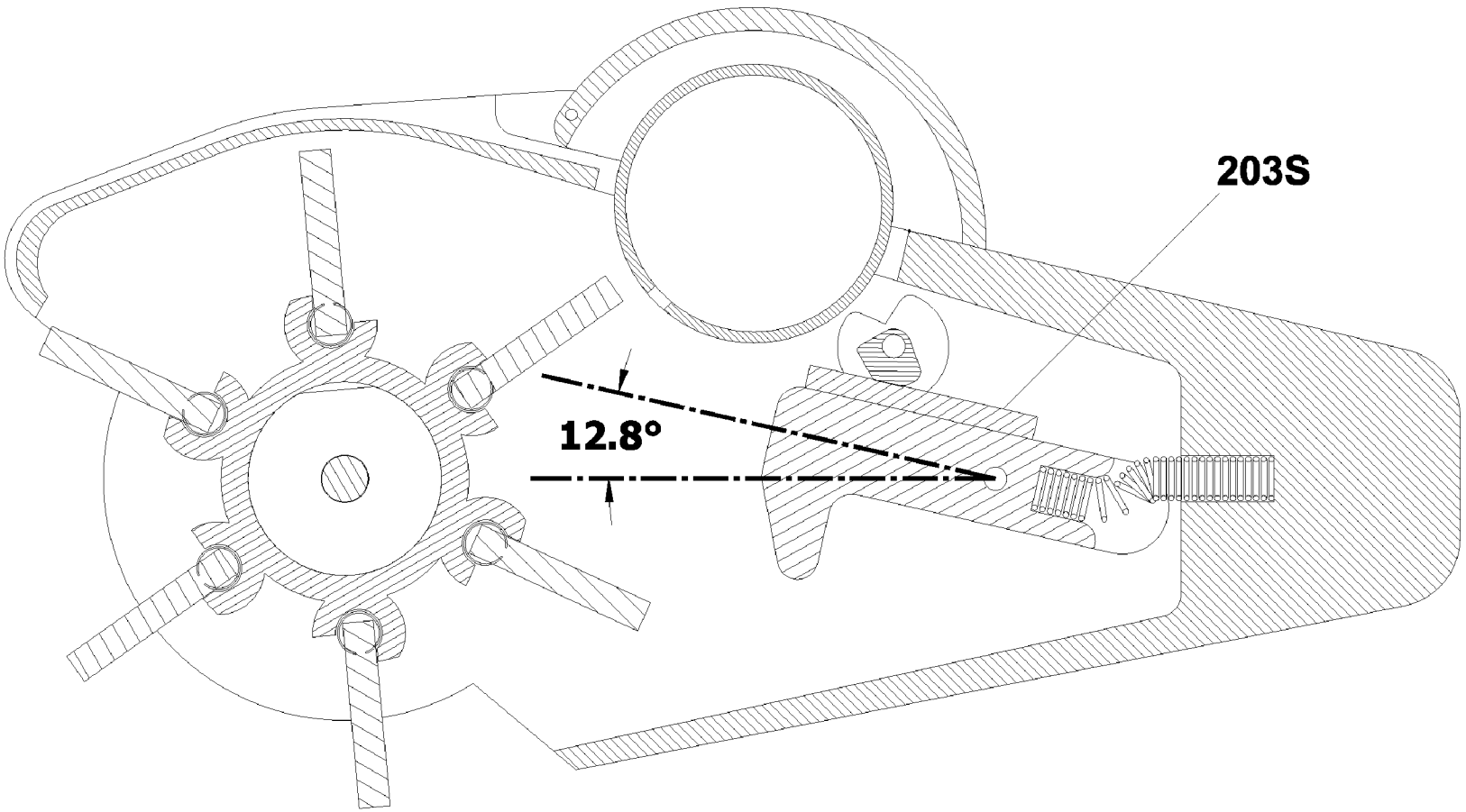
Figure 30:
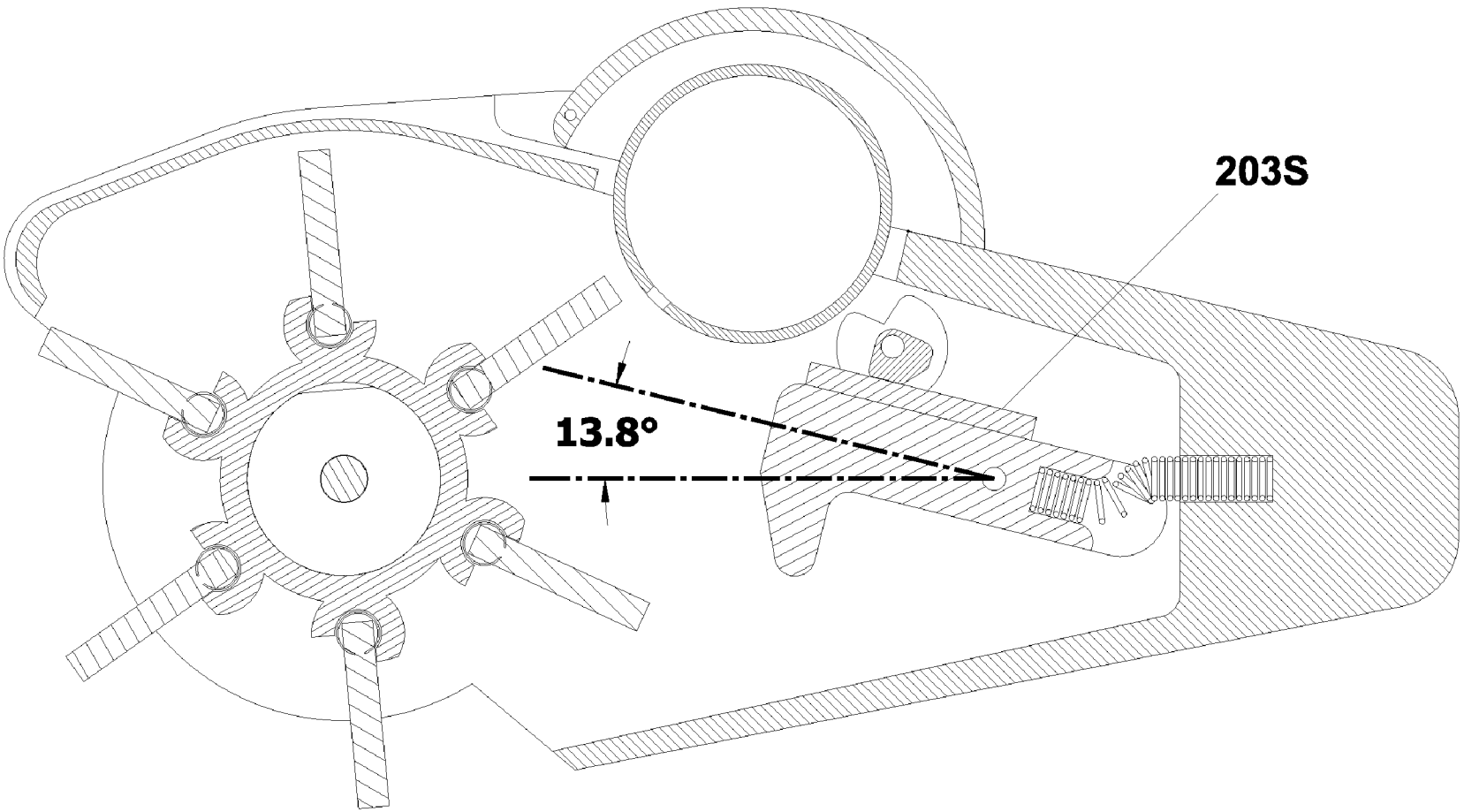

More specifically, and referring to FIGS. 27-31, FIG. 27 is an enlarged view of cam 228 showing faces 228L, 228M, 228N, and 228P. This figure also shows the distances in inches of the faces from the center line 204C of the cam shaft 204. As an example, they are as follows: E—0.219, F—0.201, G—0.184 and H—0.093. These distances are in inches. This arrangement provides four stable rotational positions for the cam to be engaging the ledge 203S to provide four angles of attitude of the nozzle. For position 1 in FIG. 28, the cam face 228P engages the ledge 203S so that the nozzle wall 212 intercepts the incoming fluid stream at an angle of 11.8° above a horizontal plane between the nozzle pivot axis 204C and the scrubber wheel axis 193C. Using the cam control knob 228K to turn the cam one step in the direction of arrow 228R, will place the cam face 228N against the ledge 203S and increase the angle of the wall 212 to 12.8° as shown in FIG. 29.

Further turning of the knob in the direction of arrow 228R will advance the cam to the next step placing the face 228M on the ledge 203S increasing the nozzle angle to 13.8°. Further turning of the cam control knob 228K in the direction of arrow 228R will place the cam surface 228L against the ledge 203S increasing the angle of the shelf 212 to 20.8°.

The foregoing series of steps using the cam control knob moves the shelf 212 from the first position shown in FIG. 28 where there is not enough discharge of the driving fluid 211 onto the cartridge 206 to cause it to spin. Therefore, it will remain at rest. The additional three steps turning the cam control knob in the direction of arrow 228R will increase the contact of portions of fluid 211 contacting the perimeter of the cartridge to change the speed from stop to slow to medium to fast. Thus, with a cam situated and formed as shown, the operator can conveniently adjust the rotational speed of the cartridge.

Figure 19:
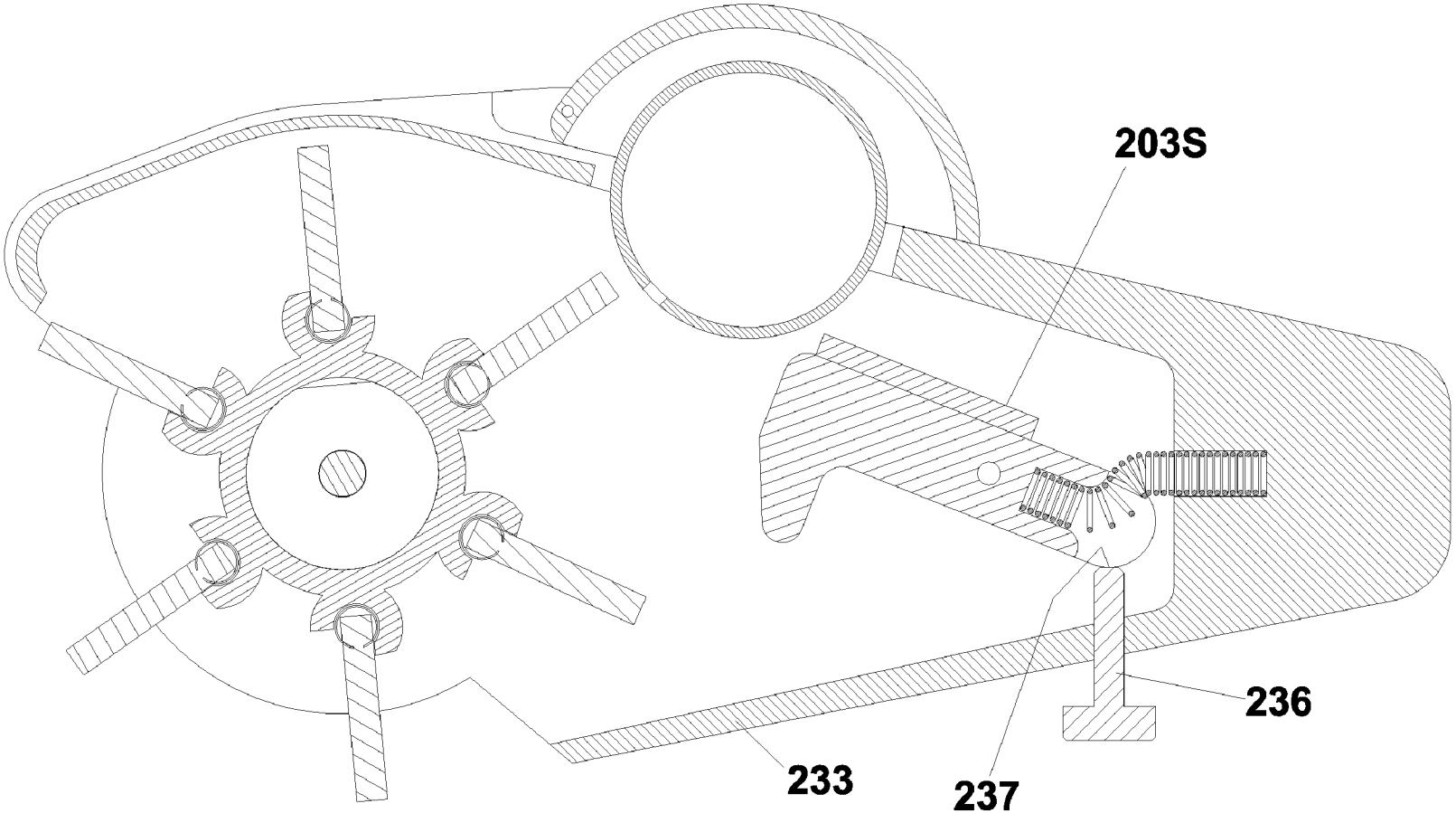
FIG. 19 is a view similar to FIG. 16 and showing an adjustable screw pivot stop for the nozzle discharge direction deflector plate adjustment screw.

FIG. 19 shows an adjustment screw 236 threaded into the bottom wall 233 of the housing. The tip 237 of the screw engages the bottom rear side of the nozzle and enables fine adjustment of nozzle angle if that is preferred over the use of the cam alone for controlling spin of the cartridge 206.

Figure 18:
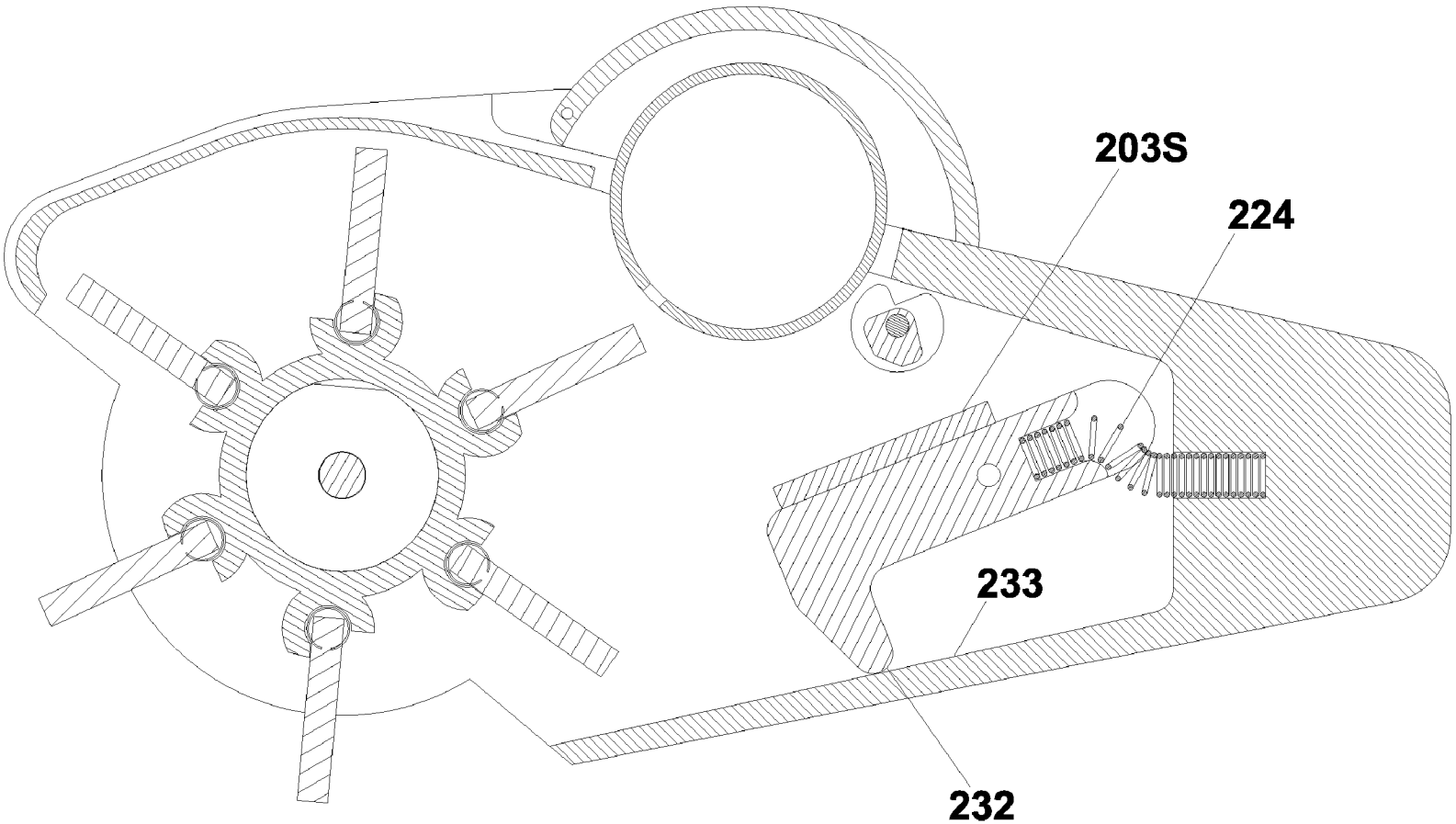
FIG. 18 is a view similar to FIG. 16 but showing the discharge stabilizer spring holding the stabilizer in the position shown in FIG. 17.

FIG. 17 shows the nozzle tilted downward whereby the fluid discharged from nozzle 203 is downward and forward in the direction of arrow 231. This is done by turning nozzle shifting knob 205 (FIG. 11 and shown in dashed lines in FIG. 12 because it is on housing side 201) in the direction of arrow 228R. Fastened to the shaft 204, the knob turns the nozzle down so the bottom 212B of nozzle wall 212 intercepts the incoming fluid stream. During this shift of the nozzle, the spring seat in the nozzle moves above center of the seat in the housing so now the spring will maintain this nozzle attitude even if the fluid supply is shut off from the tool. Reverse turn of the knob 205 can return the nozzle to the FIG. 13-16 attitude. The FIG. 17 attitude is useful if the operator of the tool does not want any of the scrubbing solution to come backward as the tool is moved forward over the surface to be treated. For this purpose it will be noted that the scrubbing wheel is installed with the pivot stops such as 252, 253, facing the direction opposite of what they were in the examples of FIGS. 13 and 16. The stabilizing spring maintains the downward attitude of the deflector for this operation. The nozzle tip 232 is stopped on the bottom interior wall 233 of the housing as shown in FIG. 18.

Referring now to FIG. 20, together along with FIGS. 13-19, this exploded view of nozzle 203 shows deflector plate portion 203B and deflector cap portion 203C. These parts are fastened together by screws 203D. The sides of the deflector plate 203B portion of the nozzle and which are bridged by the wall 212 have inside faces 212U above and 212L below the wall 212. These are flared outward as best shown in FIG. 20 to receive the pressurized fluid 211 entering the housing at the rear end of the nozzle. Therefore, when the nozzle is directed upward as in FIGS. 13-16, the entering stream 211 can spread laterally the width of the treating elements 198 on the wheel. The cap portion 203C of the nozzle slopes downward and forward from the rear edge 203R to the front edge 203F, across the width of the nozzle, converging toward the front of the nozzle, to avoid any overspray from the incoming stream 211 from spinning of the cartridge 206 when it is not desired, as in the nozzle position FIG. 13.

Referring now to FIGS. 22 through 26, FIG. 22 is an example of the cam 139 and showing the four faces selectively usable by the cam operating knob 127 to move the nozzle 137 up or down to change the discharge direction 138. As examples, these four faces can provide discharge directions ranging upward from 18.3° above a plane containing the rotational axis of the scrubber wheel and the axis of the cam shaft 141. At this angle, the fluid discharge does not rotate the cartridge 166. Using the cam control knob 127 to turn the cam in the direction of arrow 154 will change the angle to 19.3° when the cam face 139B engages the bottom of the nozzle. Turning further to the third position placing the cam face 139C against the bottom of the nozzle increases the angle to 19.5°. A further turn of the cam to place the surface 139D against the bottom of the nozzle changes the angle to 19.7°. In these three steps from the position 1 of FIG. 23 to the position 4 of FIG. 26 changes the cartridge condition from stationary at position 1 of FIG. 23 to slow, medium and fast speeds at positions 2, 3 and 4 shown respectively in FIGS. 24, 25 and 26.

As an example of the differences in distance of the nozzle engaging faces 139A through 139D, the distance of the cam face 139A from the cam shaft axis 141C is 0.093 inches. The distance from the cam face 139B to the cam shaft axis is 0.177 inches. The distance from the cam face 139C to the cam shaft axis is 0.196 inches. The distance from the cam face 139D to the cam shaft axis is 0.218 inches. These and the above set of dimensions for the embodiment of FIGS. 11 through 31 are merely examples. Other dimensions may be selected for other sizes of apparatus. In the present examples, the scrubber wheel for FIGS. 1 through 10 and FIGS. 22 through 26 embodiment was approximately four inches, whereas the scrubber wheel for the FIGS. 11 through 21 and FIGS. 27 through 31 was approximately two inches.

One example of the treatment material is a material known as Scotch-Brite®. The treatment portions of the scrubbing elements may be, for example, pads with any desirable "grit" of Scotch-Brite®. The material needs to be sufficiently sturdy to be able to remain straight out when impacted by the blast from the different types of nozzles, particularly when wet with water. It has been found that some automobile floor carpeting media with a "terry cloth" covering applied to it works well for some scrubbing applications using water as the carrier medium for washing with soap or other cleaning material in the cartridge, or as the carrier medium for polishing and/or waxing with a liquid wax in the replaceable cartridge. The cartridge could be a refillable type, but it is considered preferable that it be a single-fill, disposable, "throw-away" item after contents have been used.

While the various embodiments have multiple applications for scrubbing, polishing, waxing, or other treatment of a surface, it might be found more attractive to use the version shown in FIGS. 1-10 with the integral handle for smaller size job. As an example, that embodiment may have a handle 1½ inches wide and a 2 inch diameter wheel. The embodiment of FIGS. 11-18 might have a 4 inch diameter wheel about 5 inches wide with a screw-on water delivery handle 4 feet long. Thus, the larger size may be preferred for larger areas such as decks, building windows, trucks and railroad cars. Still larger sizes may be used for larger projects and mounted on booms and operated manually or robotically. It is seen that the apparatus has a great variety of possible uses and sized accordingly. Indeed, in appropriate sizes and materials, it may also be used for washing or scrubbing hair or for skin exfoliation. In such variety of uses, the dispenser cartridge can be made in size appropriate to the task. Moreover, it is noted that wheels 225 are provided on the application apparatus embodiment of FIGS. 11 and 12. Such apparatus with treatment material cartridge in appropriate size can be used for other applications including, but not limited to, application of liquid vegetation killers or fertilizers to orchards, farms, gardens or lawns. Such apparatus could incorporate or omit a scrubber wheel.

It was mentioned above that the opening 172 for exit of the liquid treatment material in the FIGS. 1-10 apparatus, may be round or other shape or size or multiple openings. As an example, in tests where the opening is round, a single 0.018 inch diameter has worked well with Meguiar's "Deep Crystal Car Wash" material. A single 0.028 inch diameter has worked well with Meguiar's "No. 50 Cleaner Wax". A single 0.036 inch diameter has worked well with Meguiar's "No. 54 Gel Wash". Similarly, the opening 207 in the FIGS. 11-19 apparatus may be round or other shape or size or multiple openings. Because it is intended that cartridges for different purposes, such as washing, polishing, waxing or otherwise treating a surface, are intended to be readily inserted and removed as needed or exhausted, the particular cartridge can be provided by the manufacturer with the hole size and location known to be best suited to the treatment material contained in the cartridge.

In the case of a single opening in the cartridge, it is likely to be located equidistant from the ends of the cartridge. Or, if there is a desire that the dispensed material not directly mix with the cartridge driving fluid, the opening or openings can be offset toward one end of cartridge, and the nozzle can be offset toward the other end of the cartridge. Or, the nozzle discharge can be shielded from the treatment material discharge circle of the spinning cartridge. Also, as noted above, and as can be seen in FIG. 4*a*, the width of the nozzle opening 137 can be less than the length of the cartridge 173. Also, comparing the FIGS. 1-10 apparatus, with the FIGS. 11-19 apparatus, the nozzle shapes can be different. The cartridge can function when associated with other nozzle outlet shapes.

While the term "scrubber" or "scrubbing" or the like has been used frequently herein, it should be interpreted broadly, as the apparatus is clearly adaptable to a variety of types of treatment of a variety of types surfaces.

What is claimed is:

1. A portable apparatus for treating a surface and comprising:

a handle having a proximal portion for holding in a person's hand and a distal portion for delivering a carrier fluid to the surface;

a carrier fluid supply fitting at the proximal portion for connection to a source of carrier fluid;

a housing at the distal portion of the handle;

a treatment material cartridge mounted to said housing for rotation on an axis and containing treatment material in liquid form, said cartridge having an outlet opening;

a nozzle at the housing, said nozzle having an inlet to receive said carrier fluid, and said nozzle having an outlet to discharge said carrier fluid in a stream having a discharge direction;

a carrier fluid delivery passageway from said supply fitting to said nozzle inlet;

a wheel mounted in the housing for rotation on a second axis in the housing; and a plurality of surface treating elements circularly spaced around the wheel, wherein said nozzle is adjustable to change said carrier fluid stream discharge direction relative to said axis of the cartridge, wherein the nozzle is sufficiently adjustable to cause the discharge direction of carrier fluid from the outlet to impinge the treating elements and thereby rotate the wheel on the second axis, and wherein the nozzle, the cartridge, and the wheel are arranged to enable a discharge direction of the carrier fluid to impinge portions of the cartridge and the treating elements to enable simultaneous rotation of the cartridge and the treating elements on their respective axes.

2. The apparatus of claim 1 and wherein:

said cartridge is configured to be removable from said housing.

3. The apparatus of claim 1 and wherein:

said nozzle is adjustable to change the discharge direction from a direction initiating rotation of said cartridge on said axis to a direction permitting rotation to cease, and is adjustable to change the discharge direction to change the speeds of rotation of said cartridge and said wheel.

4. The apparatus of claim 3 and wherein:

said outlet opening on said cartridge is located such that discharge of treatment material liquid from inside said cartridge increases as said cartridge is rotated at increasing speed.

5. The apparatus of claim 3 and further comprising:

a cam mounted to pivot in said housing and operable on said nozzle to move said nozzle to change the rotational speeds of said cartridge and said wheel; and a manipulator outside said housing and coupled to said cam for moving said cam to adjust said nozzle to at least one or another of two different discharge directions.

6. The apparatus of claim 4 and wherein:

said nozzle has a deflector plate portion which has a rear end and a front end, said rear end is at said nozzle inlet and said front end is facing said wheel;

said nozzle has a cap portion covering said plate portion and which has a rear end and a front end, said rear end faces said nozzle inlet and said front end faces said wheel;

said deflector plate portion has a top surface receiving said carrier fluid entering said housing from said passageway, and directing said received carrier fluid toward said wheel above said second axis when said nozzle is in one orientation; and said deflector plate portion has a bottom surface receiving said carrier fluid entering said housing from said passageway when said nozzle is in another orientation and directs said received fluid toward said wheel below said second axis.

7. The apparatus of claim 6 and further comprising:

sidewalls above and below said plate portion.

8. The apparatus of claim 7 and wherein:

said cap portion converges toward said plate portion from said rear end of said cap portion to said front end of said cap portion.

9. The apparatus of claim 8 and wherein:

said nozzle is spring loaded for stabilization of said nozzle in said one orientation and, alternatively, in said another orientation.

10. The combination of claim 1 and further comprising:

a cover on said housing and covering said cartridge; and wherein:

said cartridge has a mounting device configured to facilitate removal of the cartridge from the housing;

said housing has a surface with a receiver for receiving said mounting device to support said cartridge for rotation on said housing; and said cover has a retainer cooperating with said receiver on said housing to retain said mounting device while said cover is covering said cartridge.

11. The combination of claim 10 and wherein:

said cover is biased to hold said cover in position covering and retaining said cartridge in position for rotation on said housing; and said cover is operable to be opened by pivoting against said bias to remove and dispose said cartridge when empty and replace with a new cartridge.

12. The apparatus of claim 1 and further comprising:

an adjuster associated with said nozzle to direct said stream to a discharge direction to contact a portion of said cartridge and initiate rotation of said cartridge on said axis.

13. The apparatus of claim 12 and wherein:

said adjuster is operable to change discharge direction to change contact of said stream with said cartridge to change speed of rotation of said cartridge.

14. The apparatus of claim 13 and wherein:

said adjuster has at least four stable positions for establishing four different stream discharge directions including one avoiding rotation of said cartridge and three others providing three different rotational speeds of said cartridge.

15. A portable apparatus for treating a surface, the apparatus comprising:

a handle portion having a proximal end configured to receive a supply of fluid and a distal end opposite the proximal end;

a fitting at the proximal end configured to be coupled to a source of fluid;

a housing at the distal end portion of the handle portion;

a treatment material cartridge associated with the housing, the treatment material cartridge having an outlet opening and an axis about which the treatment material cartridge is configured to rotate, the treatment material cartridge being configured to contain a supply of treatment material in liquid form and discharge treatment material via the outlet opening; and a nozzle associated with the housing, the nozzle having an inlet configured to receive fluid and an outlet configured to discharge fluid in a discharge direction; and a scrubbing wheel coupled to the housing and configured to rotate about an axis of the scrubbing wheel, wherein the nozzle is configured to be adjustable to alter the discharge direction relative to the housing, wherein the treatment material cartridge is configured to discharge treatment material via the outlet opening as the treatment material cartridge rotates about the axis, wherein the nozzle is configured to be adjustable to alter the discharge direction of fluid from a direction toward the scrubbing wheel, such that the scrubbing wheel rotates, to a direction toward the treatment material dispenser, such that the treatment material dispenser rotates and discharges treatment material via the outlet opening, and wherein the nozzle, the treatment material cartridge, and the scrubbing wheel are configured and arranged such that the treatment material cartridge and the scrubbing wheel rotate simultaneously based on the discharge direction of fluid.

16. A portable apparatus for treating a surface, the apparatus comprising:

a handle portion having a proximal end configured to receive a supply of fluid and a distal end opposite the proximal end;

a fitting at the proximal end configured to be coupled to a source of fluid;

a housing at the distal end portion of the handle portion;

a treatment material cartridge associated with the housing, the treatment material cartridge having an outlet opening and an axis about which the treatment material cartridge is configured to rotate, the treatment material cartridge being configured to contain a supply of treatment material in liquid form and discharge treatment material via the outlet opening;

a nozzle associated with the housing, the nozzle having an inlet configured to receive fluid and an outlet configured to discharge fluid in a discharge direction; and a scrubbing wheel coupled to the housing and configured to rotate about an axis of the scrubbing wheel, wherein the nozzle is configured to be adjustable to alter the discharge direction relative to the housing, wherein the treatment material cartridge is configured to discharge treatment material via the outlet opening as the treatment material cartridge rotates about the axis, wherein the nozzle is configured to be adjustable to alter the discharge direction of fluid from a direction toward the scrubbing wheel, such that the scrubbing wheel rotates, to a direction toward the treatment material dispenser, such that the treatment material dispenser rotates and discharges treatment material via the outlet opening, and wherein the nozzle is adjustable to alter the discharge direction from a direction initiating rotation of the treatment material cartridge to a direction in which rotation of the treatment material cartridge ceases, and wherein the nozzle is adjustable to alter the discharge direction in a manner that changes the speed of rotation of at least one of the treatment material cartridge and the scrubbing wheel.

* * * * *